US012253288B2

(12) United States Patent
Saeki et al.

(10) Patent No.: US 12,253,288 B2
(45) Date of Patent: Mar. 18, 2025

(54) REFRIGERATION CYCLE APPARATUS

(71) Applicant: DAIKIN INDUSTRIES, LTD., Osaka (JP)

(72) Inventors: Kumiko Saeki, Osaka (JP); Yuta Iyoshi, Osaka (JP); Yoshiki Yamanoi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/621,723

(22) Filed: Mar. 29, 2024

(65) Prior Publication Data

US 2024/0240841 A1 Jul. 18, 2024

Related U.S. Application Data

(63) Continuation of application No. PCT/JP2022/035462, filed on Sep. 22, 2022.

(30) Foreign Application Priority Data

Sep. 30, 2021 (JP) ..... 2021-161998

(51) Int. Cl.
*F25B 41/26* (2021.01)
*F25B 13/00* (2006.01)

(52) U.S. Cl.
CPC ..... *F25B 41/26* (2021.01); *F25B 13/00* (2013.01)

(58) Field of Classification Search
CPC ..... F25B 13/00; F25B 41/26
See application file for complete search history.

(56) References Cited

U.S. PATENT DOCUMENTS 5,586,443 A 12/1996 Lewis
5,802,860 A * 9/1998 Barrows ..... F25B 41/20 62/197

(Continued)

FOREIGN PATENT DOCUMENTS

CN 203615654 U 5/2014
CN 207501503 U 6/2018

(Continued)

OTHER PUBLICATIONS

International Preliminary Report on Patentability and English translation of the Written Opinion of the International Searching Authority for International Application No. PCT/JP2022/035462, dated Apr. 11, 2024.

(Continued)

*Primary Examiner* — Henry T Crenshaw
(74) *Attorney, Agent, or Firm* — Birch, Stewart, Kolasch & Birch, LLP

(57) ABSTRACT

A safety valve includes a secondary-side refrigerant circuit that includes a secondary-side receiver that reserves a refrigerant, a flow path switching portion that includes a first connecting portion, a second connecting portion, and a third connecting portion connected to the secondary-side receiver, the flow path switching portion (96) that switches between a first state in which the third connecting portion communicates with the first connecting portion and a second state in which the third connecting portion communicates with the second connecting portion, and a safety valve that includes a safety valve connecting portion connected to the first connecting portion or the second connecting portion, and releases the refrigerant to outside when a refrigerant pressure in the secondary-side receiver satisfies a predetermined condition, in which at least the safety valve connecting portion is made of stainless steel.

20 Claims, 11 Drawing Sheets

(56) References Cited

U.S. PATENT DOCUMENTS

| | | | | |
|---|---|---|---|---|
| 9,182,164 | B1 * | 11/2015 | Henderson, Jr. ..... | F24F 1/022 |
| 2017/0321941 | A1 * | 11/2017 | Fredslund ..... | F25B 41/39 |

FOREIGN PATENT DOCUMENTS

| | | | |
|---|---|---|---|
| CN | 207688454 | U | 8/2018 |
| CN | 208332770 | U | 1/2019 |
| JP | 7-324828 | A | 12/1995 |
| JP | 2020-153557 | A | 9/2020 |

OTHER PUBLICATIONS

International Search Report (PCT/ISA/210) issued in PCT/JP2022/035462 mailed on Nov. 15, 2022.
Extended European Search Report for European Application No. 22876056.7, dated Dec. 16, 2024.

* cited by examiner

REFRIGERATION CYCLE APPARATUS

CROSS REFERENCE TO RELATED APPLICATIONS

This application is a Continuation of PCT International Application No. PCT/JP2022/035462, filed on Sep. 22, 2022, which claims priority under 35 U.S.C. § 119(a) to Patent Application No. JP 2021-161998, filed in Japan on Sep. 30, 2021, all of which are hereby expressly incorporated by reference into the present application.

TECHNICAL FIELD

The present disclosure relates to a refrigeration cycle apparatus.

BACKGROUND ART

Conventionally, a receiver for reserving a refrigerant has been used in a refrigerant circuit included in a refrigeration cycle apparatus.

For example, in a refrigeration cycle apparatus described in Patent Literature 1 (JP H07-324828 A), a high-pressure receiver, an intermediate-pressure receiver, and the like are used in a refrigerant circuit.

SUMMARY

A refrigeration cycle apparatus according to a first aspect includes a refrigerant circuit, a flow path switching portion, and a safety valve. The refrigerant circuit includes a refrigerant vessel that reserves a refrigerant. The flow path switching portion includes a first connecting portion, a second connecting portion, and a third connecting portion. The third connecting portion is connected to the refrigerant vessel. The flow path switching portion switches between a first state in which the third connecting portion communicates with the first connecting portion and a second state in which the third connecting portion communicates with the second connecting portion. The safety valve releases the refrigerant to outside when a refrigerant pressure in the refrigerant vessel satisfies a predetermined condition. The safety valve includes a fourth connecting portion. The fourth connecting portion is connected to the first connecting portion or the second connecting portion. At least the fourth connecting portion of the safety valve is made of stainless steel. A potential difference between the first connecting portion and the fourth connecting portion is 0.35 V or less. A potential difference between the second connecting portion and the fourth connecting portion is 0.35 V or less. An allowable tensile stress of the fourth connecting portion with respect to an allowable tensile stress of the first connecting portion (the allowable tensile stress of the fourth connecting portion/the allowable tensile stress of the first connecting portion) is 3.0 times or less. An allowable tensile stress of the fourth connecting portion with respect to the allowable tensile stress of the second connecting portion (the allowable tensile stress of the fourth connecting portion/the allowable tensile stress of the second connecting portion) is 3.0 times or less.

DESCRIPTION OF EMBODIMENTS

(1) Configuration of Refrigeration Cycle Apparatus

Figure 1:
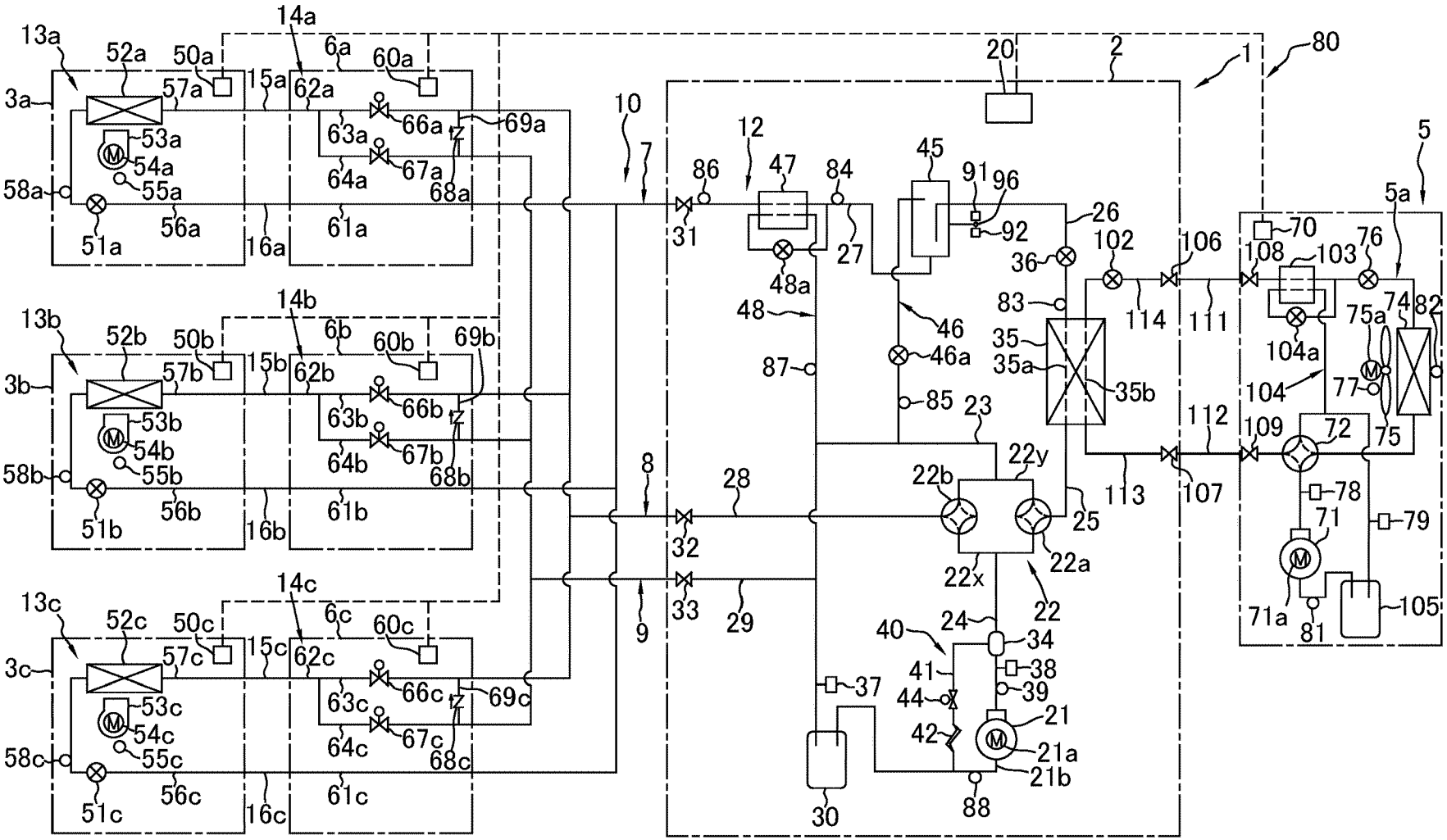
FIG. 1 is a schematic configuration diagram of a refrigeration cycle apparatus.
Figure 2:
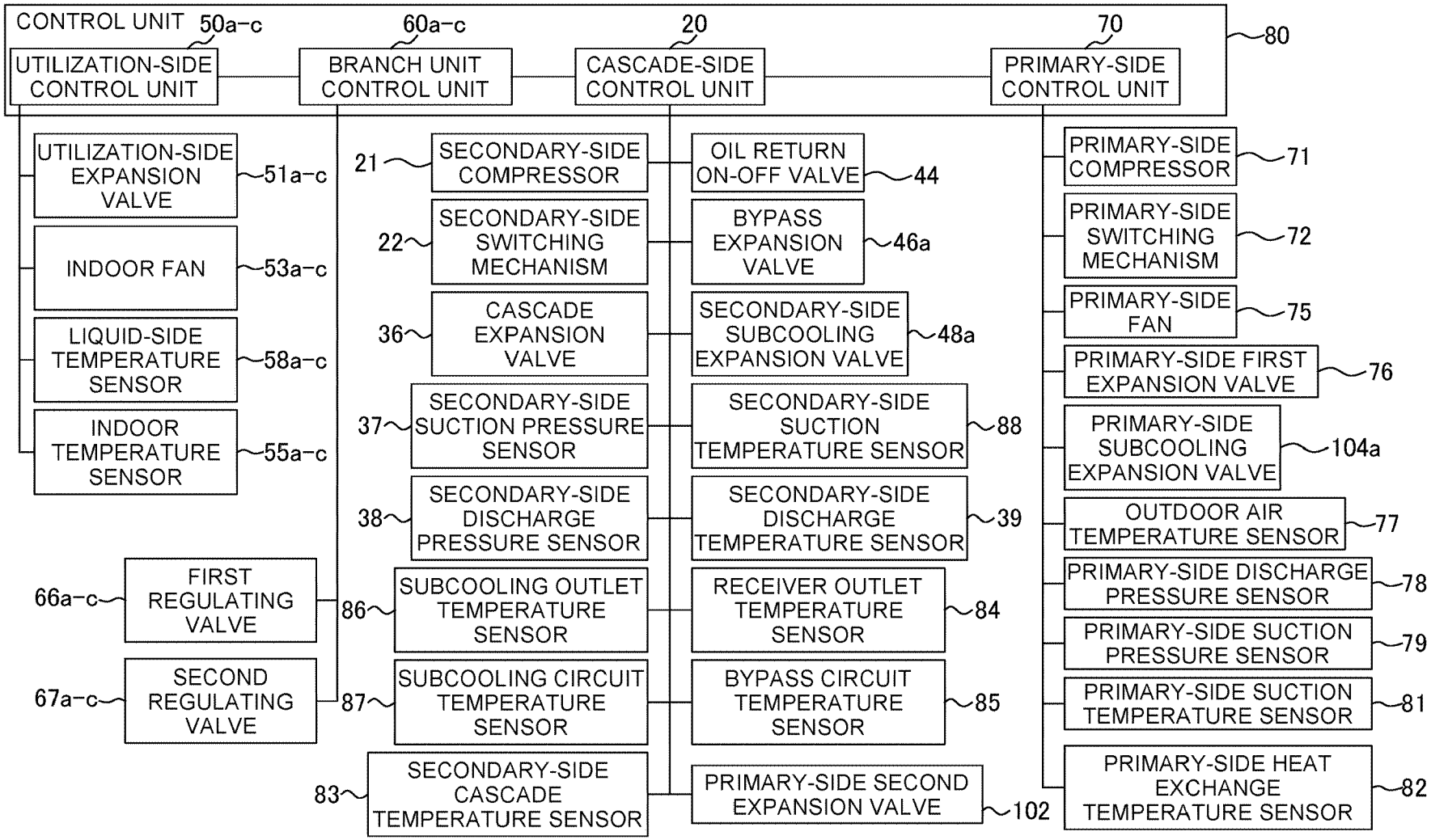
FIG. 2 is a schematic functional block configuration diagram of the refrigeration cycle apparatus.

FIG. 1 is a schematic configuration diagram of a refrigeration cycle apparatus 1. FIG. 2 is a schematic functional block configuration diagram of the refrigeration cycle apparatus 1.

The refrigeration cycle apparatus 1 is an apparatus used for cooling and heating of an indoor space in a building or the like by performing vapor compression refrigeration cycle operation.

The refrigeration cycle apparatus 1 includes a binary refrigerant circuit including a vapor compression primary-side refrigerant circuit 5*a* (corresponding to a first circuit) and a vapor compression secondary-side refrigerant circuit 10 (corresponding to a refrigerant circuit), and performs a binary refrigeration cycle. In the present embodiment, for example, R32 or R410A is sealed as a refrigerant in the primary-side refrigerant circuit 5*a*. In the secondary-side refrigerant circuit 10, for example, carbon dioxide is sealed as a refrigerant. The primary-side refrigerant circuit 5*a* and the secondary-side refrigerant circuit 10 are thermally connected via a cascade heat exchanger 35 described later.

The refrigeration cycle apparatus 1 is configured by connecting a primary-side unit 5, a cascade unit 2, a plurality of branch units 6*a*, 6*b*, and 6*c*, and a plurality of utilization units 3*a*, 3*b*, and 3*c* to each other via pipes. The primary-side unit 5 and the cascade unit 2 are connected via a primary-side first connection pipe 111 and a primary-side second connection pipe 112. The cascade unit 2 and the plurality of branch units 6*a*, 6*b*, and 6*c* are connected via three refrigerant connection pipes, namely, a secondary-side second connection pipe 9, a secondary-side first connection pipe 8, and a secondary-side third connection pipe 7. The plurality of branch units 6*a*, 6*b*, and 6*c* and the plurality of utilization units 3*a*, 3*b*, and 3*c* are connected via first connecting tubes 15*a*, 15*b*, and 15*c* and second connecting tubes 16*a*, 16*b*, and 16*c*. The present embodiment provides the single primary-side unit 5. The present embodiment provides the single cascade unit 2. The plurality of utilization units 3*a*, 3*b*, and 3*c* according to the present embodiment includes three utilization units, namely, the first utilization unit 3*a*, the second utilization unit 3*b*, and the third utilization unit 3*c*. In the present embodiment, the plurality of branch units 6*a*, 6*b*, and 6*c* is three branch units, namely, the first branch unit 6*a*, the second branch unit 6*b*, and the third branch unit 6*c*.

In the refrigeration cycle apparatus 1, the utilization units 3*a*, 3*b*, and 3*c* can individually perform cooling operation or heating operation, and heat can be recovered between the utilization units by sending a refrigerant from the utilization unit performing the heating operation to the utilization unit performing the cooling operation. Specifically, heat is recovered in the present embodiment by performing cooling main operation or heating main operation of simultaneously performing cooling operation and heating operation. In addition, the refrigeration cycle apparatus 1 is configured to balance heat loads of the cascade unit 2 in accordance with entire heat loads of the plurality of utilization units 3*a*, 3*b*, and 3*c* also in consideration of the heat recovery (the cooling main operation or the heating main operation).

(2) Primary-Side Refrigerant Circuit

The primary-side refrigerant circuit 5*a* includes a primary-side compressor 71, a primary-side switching mechanism 72, a primary-side heat exchanger 74, a primary-side first expansion valve 76, a primary-side subcooling heat exchanger 103, a primary-side subcooling circuit 104, a primary-side subcooling expansion valve 104*a*, a first liquid shutoff valve 108, the primary-side first connection pipe 111, a second liquid shutoff valve 106, the second refrigerant pipe 114, a primary-side second expansion valve 102, the cascade heat exchanger 35 shared with the secondary-side refrigerant circuit 10, a first refrigerant pipe 113, a second gas shutoff valve 107, the primary-side second connection pipe 112, a first gas shutoff valve 109, and a primary-side accumulator 105. This primary-side refrigerant circuit 5*a* specifically includes a primary-side flow path 35*b* of the cascade heat exchanger 35.

The primary-side compressor 71 is a device for compressing a primary-side refrigerant, and includes, for example, a scroll type or other positive-displacement compressor whose operating capacity can be varied by controlling an inverter for a compressor motor 71*a*.

The primary-side accumulator 105 is provided at a halfway portion of the suction flow path connecting the primary-side switching mechanism 72 and a suction side of the primary-side compressor 71.

When the cascade heat exchanger 35 functions as an evaporator for the primary-side refrigerant, the primary-side switching mechanism 72 enters a fifth connection state of connecting the suction side of the primary-side compressor 71 and a gas side of a primary-side flow path 35*b* of the cascade heat exchanger 35 (see solid lines in the primary-side switching mechanism 72 in FIG. 1). When the cascade heat exchanger 35 functions as a radiator for the primary-side refrigerant, the primary-side switching mechanism 72 enters a sixth connection state of connecting a discharge side of the primary-side compressor 71 and the gas side of the primary-side flow path 35*b* of the cascade heat exchanger 35 (see broken lines in the primary-side switching mechanism 72 in FIG. 1). In such a manner, the primary-side switching mechanism 72 is a device that can switch the flow path of the refrigerant in the primary-side refrigerant circuit 5*a*, and includes, for example, a four-way switching valve. Then, by changing a switching state of the primary-side switching mechanism 72, the cascade heat exchanger 35 can function as the evaporator or the radiator for the primary-side refrigerant.

The cascade heat exchanger 35 is a device for causing heat exchange between a refrigerant such as R32 which is a primary-side refrigerant and a refrigerant such as carbon dioxide which is a secondary-side refrigerant without mixing the refrigerants with each other. The cascade heat exchanger 35 is, for example, a plate-type heat exchanger. The cascade heat exchanger 35 includes a secondary-side flow path 35*a* belonging to the secondary-side refrigerant circuit 10 and the primary-side flow path 35*b* belonging to the primary-side refrigerant circuit 5*a*. The secondary-side flow path 35*a* has a gas side connected to a secondary-side switching mechanism 22 via a third pipe 25, and a liquid side connected to a cascade expansion valve 36 via a fourth pipe 26. The primary-side flow path 35*b* has a gas side connected to the primary-side compressor 71 via the first refrigerant pipe 113, the second gas shutoff valve 107, the primary-side second connection pipe 112, the first gas shutoff valve 109, and the primary-side switching mechanism 72, and has a liquid side connected to the second refrigerant pipe 114 provided with the primary-side second expansion valve 102.

The primary-side heat exchanger 74 is a device for exchanging heat between the primary-side refrigerant and outdoor air. The primary-side heat exchanger 74 has a gas side connected to a pipe extending from the primary-side switching mechanism 72. Examples of the primary-side heat exchanger 74 include a fin-and-tube heat exchanger including a large number of heat transfer tubes and fins.

The primary-side first expansion valve 76 is provided on a liquid pipe extending from a liquid side of the primary-side heat exchanger 74 to the primary-side subcooling heat exchanger 103. The primary-side first expansion valve 76 is an electrically powered expansion valve that has an adjustable opening degree for adjusting a flow rate of the primary-side refrigerant flowing in a portion on a liquid side of the primary-side refrigerant circuit 5*a*.

The primary-side subcooling circuit 104 branches from a portion between the primary-side first expansion valve 76 and the primary-side subcooling heat exchanger 103, and is connected to a portion between the primary-side switching mechanism 72 and the primary-side accumulator 105 on the suction flow path. The primary-side subcooling expansion valve 104*a* is an electrically powered expansion valve that is provided upstream of the primary-side subcooling heat exchanger 103 in the primary-side subcooling circuit 104 and has an adjustable opening degree for adjusting the flow rate of the primary-side refrigerant.

The primary-side subcooling heat exchanger 103 causes heat exchange between a refrigerant flowing from the primary-side first expansion valve 76 toward the first liquid shutoff valve 108 and a refrigerant decompressed at the primary-side subcooling expansion valve 104*a* in the primary-side subcooling circuit 104.

The primary-side first connection pipe 111 is a pipe connecting the first liquid shutoff valve 108 and the second liquid shutoff valve 106, and connects the primary-side unit 5 and the cascade unit 2.

The primary-side second connection pipe 112 is a pipe connecting the first gas shutoff valve 109 and the second gas shutoff valve 107, and connects the primary-side unit 5 and the cascade unit 2.

The second refrigerant pipe 114 is a pipe extending from a liquid side of the primary-side flow path 35*b* of the cascade heat exchanger 35 to the second liquid shutoff valve 106.

The primary-side second expansion valve 102 is provided on the second refrigerant pipe 114. The primary-side second expansion valve 102 is an electrically powered expansion valve that has an adjustable opening degree for adjusting a flow rate of the primary-side refrigerant flowing in the primary-side flow path 35*b* of the cascade heat exchanger 35.

The first refrigerant pipe 113 is a pipe extending from the gas side of the primary-side flow path 35*b* of the cascade heat exchanger 35 to the second gas shutoff valve 107.

The first gas shutoff valve 109 is provided between the primary-side second connection pipe 112 and the primary-side switching mechanism 72.

(3) Secondary-Side Refrigerant Circuit

The secondary-side refrigerant circuit 10 includes the plurality of utilization units 3*a*, 3*b*, and 3*c*, the plurality of branch units 6*a*, 6*b*, and 6*c*, and the cascade unit 2, which are connected to each other. Each of the utilization units 3*a*, 3*b*, and 3*c* is connected to a corresponding one of the branch units 6*a*, 6*b*, and 6*c* one by one. Specifically, the utilization unit 3*a* and the branch unit 6*a* are connected via the first connecting tube 15*a* and the second connecting tube 16*a*, the utilization unit 3*b* and the branch unit 6*b* are connected via the first connecting tube 15*b* and the second connecting tube 16*b*, and the utilization unit 3*c* and the branch unit 6*c* are connected via the first connecting tube 15*c* and the second connecting tube 16*c*. Each of the branch units 6*a*, 6*b*, and 6*c* are connected to the cascade unit 2 via three connection pipes, namely, the secondary-side third connection pipe 7, the secondary-side first connection pipe 8, and the secondary-side second connection pipe 9. Specifically, the secondary-side third connection pipe 7, the secondary-side first connection pipe 8, and the secondary-side second connection pipe 9 extending from the cascade unit 2 are each branched into a plurality of pipes connected to the branch units 6*a*, 6*b*, and 6*c*.

In accordance with an operating state, either the refrigerant in a gas-liquid two-phase state or the refrigerant in a gas state flows in the secondary-side first connection pipe 8. Note that, in accordance with the operating state, the refrigerant in a supercritical state flows in the secondary-side first connection pipe 8. In accordance with the operating state, either the refrigerant in the gas-liquid two-phase state or the refrigerant in the gas state flows in the secondary-side second connection pipe 9. In accordance with the operating state, either the refrigerant in the gas-liquid two-phase state or the refrigerant in a liquid state flows in the secondary-side third connection pipe 7. Note that, in accordance with the operating state, the refrigerant in a supercritical state flows in the secondary-side third connection pipe 7.

The secondary-side refrigerant circuit 10 includes a cascade circuit 12, branch circuits 14*a*, 14*b*, and 14*c*, and utilization circuits 13*a*, 13*b*, and 13*c*, which are connected to each other.

The cascade circuit 12 mainly includes a secondary-side compressor 21, the secondary-side switching mechanism 22, a first pipe 28, a second pipe 29, a suction flow path 23, a discharge flow path 24, the third pipe 25, the fourth pipe 26, a fifth pipe 27, the cascade heat exchanger 35, the cascade expansion valve 36, a third shutoff valve 31, a first shutoff valve 32, a second shutoff valve 33, a secondary-side accumulator 30, an oil separator 34, an oil return circuit 40, a secondary-side receiver 45 (corresponding to a refrigerant vessel), a flow path switching portion 96, a first safety valve 91, a second safety valve 92, a bypass circuit 46, a bypass expansion valve 46*a*, a secondary-side subcooling heat exchanger 47, a secondary-side subcooling circuit 48, and a secondary-side subcooling expansion valve 48*a*. The cascade circuit 12 of the secondary-side refrigerant circuit 10 specifically includes the secondary-side flow path 35*a* of the cascade heat exchanger 35.

Note that the first safety valve 91 and the second safety valve 92 are connected to the secondary-side receiver 45 via the flow path switching portion 96, will be described in detail later.

The secondary-side compressor 21 is a device for compressing the secondary-side refrigerant, and is constituted, for example, by a scroll type or other positive-displacement compressor whose operating capacity can be varied by controlling an inverter for a compressor motor 21*a*. The secondary-side compressor 21 is controlled in accordance with an operating load so as to have larger operating capacity as the load increases.

The secondary-side switching mechanism 22 is a mechanism that can switch a connection state of the secondary-side refrigerant circuit 10, specifically, the flow path of the refrigerant in the cascade circuit 12. In the present embodiment, the secondary-side switching mechanism 22 includes a discharge-side connection portion 22*x*, a suction-side connection portion 22*y*, a first switching valve 22*a*, and a second switching valve 22*b*. An end of the discharge flow path 24 on a side opposite to the secondary-side compressor 21 is connected to the discharge-side connection portion 22*x*. An end of the suction flow path 23 on a side opposite to the secondary-side compressor 21 is connected to the suction-side connection portion 22*y*. The first switching valve 22*a* and the second switching valve 22*b* are provided in parallel to each other between the discharge flow path 24 and the suction flow path 23 of the secondary-side compressor 21. The first switching valve 22*a* is connected to one end of the discharge-side connection portion 22*x* and one end of the suction-side connection portion 22*y*. The second switching valve 22*b* is connected to the other end of the discharge-side connection portion 22*x* and the other end of the suction-side connection portion 22*y*. In the present embodiment, each of the first switching valve 22*a* and the second switching valve 22*b* includes a four-way switching valve. Each of the first switching valve 22*a* and the second switching valve 22*b* has four connection ports, namely, a first connection port, a second connection port, a third connection port, and a fourth connection port. In the first switching valve 22*a* and the second switching valve 22*b* according to the present embodiment, each of the fourth ports is a closed connection port not connected to the flow path of the secondary-side refrigerant circuit 10. In the first switching valve 22*a*, the first connection port is connected to the one end of the discharge-side connection portion 22*x*, the second connection port is connected to the third pipe 25 extending from the secondary-side flow path 35*a* of the cascade heat exchanger 35, and the third connection port is connected to the one end of the suction-side connection portion 22*y*. The first switching valve 22*a* switches between a switching state in which the first connection port and the second connection port are connected and the third connection port and the fourth connection port are connected and a switching state in which the third connection port and the second connection port are connected and the first connection port and the fourth connection port are connected. The second switching valve 22*b* has the first connection port connected to the other end of the discharge-side connection portion 22*x*, the second connection port connected to the first pipe 28, and the third connection port connected to the other end of the suction-side connection portion 22*y*. The second switching valve 22*b* switches between a switching state in which the first connection port and the second connection port are connected and the third connection port and the fourth connection port are connected and a switching state in which the third connection port and the second connection port are connected and the first connection port and the fourth connection port are connected.

When the secondary-side refrigerant discharged from the secondary-side compressor 21 is prevented from being sent to the secondary-side first connection pipe 8 while the cascade heat exchanger 35 functions as a radiator for the secondary-side refrigerant, the secondary-side switching mechanism 22 is switched to a first connection state in which the discharge flow path 24 and the third pipe 25 are connected by the first switching valve 22*a* and the first pipe 28 and the suction flow path 23 are connected by the second switching valve 22*b*. The first connection state of the secondary-side switching mechanism 22 is a connection state adopted during the cooling operation described later. When the cascade heat exchanger 35 functions as an evaporator for the secondary-side refrigerant, the secondary-side switching mechanism 22 is switched to a second connection state in which the discharge flow path 24 and the first pipe 28 are connected by the second switching valve 22*b* and the third pipe 25 and the suction flow path 23 are connected by the first switching valve 22*a*. The second connection state of the secondary-side switching mechanism 22 is a connection state adopted during the heating operation and during the heating main operation described later. When the secondary-side refrigerant discharged from the secondary-side compressor 21 is sent to the secondary-side first connection pipe 8 while the cascade heat exchanger 35 functions as a radiator for the secondary-side refrigerant, the secondary-side switching mechanism 22 is switched to a third connection state in which the discharge flow path 24 and the third pipe 25 are connected by the first switching valve 22*a* and the discharge flow path 24 and the first pipe 28 are connected by the second switching valve 22*b*. The third connection state of the secondary-side switching mechanism 22 is a connection state adopted during the cooling main operation described later.

As described above, the cascade heat exchanger 35 is a device for causing heat exchange between the refrigerant such as R32 which is the primary-side refrigerant and the refrigerant such as carbon dioxide which is the secondary-side refrigerant without mixing the refrigerants with each other. The cascade heat exchanger 35 includes the secondary-side flow path 35*a* in which the secondary-side refrigerant in the secondary-side refrigerant circuit 10 flows and the primary-side flow path 35*b* in which the primary-side refrigerant in the primary-side refrigerant circuit 5*a* flows, so as to be shared between the primary-side unit 5 and the cascade unit 2. Note that, in the present embodiment, the cascade heat exchanger 35 is disposed inside a cascade casing (not illustrated) of the cascade unit 2. The gas side of the primary-side flow path 35*b* of the cascade heat exchanger 35 extends to the primary-side second connection pipe 112 outside the cascade casing via the first refrigerant pipe 113 and the second gas shutoff valve 107. The liquid side of the primary-side flow path 35*b* of the cascade heat exchanger 35 extends to the primary-side first connection pipe 111 outside the cascade casing via the second refrigerant pipe 114 provided with the primary-side second expansion valve 102 and the second liquid shutoff valve 106.

The cascade expansion valve 36 is an expansion valve for adjusting a flow rate of the secondary-side refrigerant flowing in the cascade heat exchanger 35. The cascade expansion valve 36 is an electrically powered expansion valve that is connected to a liquid side of the cascade heat exchanger 35 and has an adjustable opening degree. The cascade expansion valve 36 is provided on the fourth pipe 26.

Each of the third shutoff valve 31, the first shutoff valve 32, and the second shutoff valve 33 is provided at a connecting port with an external device or pipe (specifically, the connection pipe 7, 8, or 9). Specifically, the third shutoff valve 31 is connected to the secondary-side third connection pipe 7 led out of the cascade unit 2. The first shutoff valve 32 is connected to the secondary-side first connection pipe 8 led out of the cascade unit 2. The second shutoff valve 33 is connected to the secondary-side second connection pipe 9 led out of the cascade unit 2.

The first pipe 28 is a refrigerant pipe connecting the first shutoff valve 32 and the secondary-side switching mechanism 22. Specifically, the first pipe 28 connects the first shutoff valve 32 and the second connection port of the second switching valve 22*b* of the secondary-side switching mechanism 22.

The suction flow path 23 connects the secondary-side switching mechanism 22 and a suction side of the secondary-side compressor 21. Specifically, the suction flow path 23 connects the suction-side connection portion 22*y* of the secondary-side switching mechanism 22 and the suction side of the secondary-side compressor 21. The secondary-side accumulator 30 is provided at a halfway portion of the suction flow path 23.

The second pipe 29 is a refrigerant pipe that connects the second shutoff valve 33 to a halfway portion of the suction flow path 23. In the present embodiment, the second pipe 29 is connected to the suction flow path 23 at a connection point of the suction flow path 23 between the suction-side connection portion 22*y* of the secondary-side switching mechanism 22 and the secondary-side accumulator 30.

The discharge flow path 24 is a refrigerant pipe connecting a discharge side of the secondary-side compressor 21 and the secondary-side switching mechanism 22. Specifically, the discharge flow path 24 connects the discharge side of the secondary-side compressor 21 and the discharge-side connection portion 22*x* of the secondary-side switching mechanism 22.

The third pipe 25 is a refrigerant pipe connecting the secondary-side switching mechanism 22 and a gas side of the cascade heat exchanger 35. Specifically, the third pipe 25 connects the second connection port of the first switching valve 22*a* of the secondary-side switching mechanism 22 and a gas-side end of the secondary-side flow path 35*a* in the cascade heat exchanger 35.

The fourth pipe 26 is a refrigerant pipe connecting the liquid side (opposite to the gas side, and opposite to the side provided with the secondary-side switching mechanism 22) of the cascade heat exchanger 35 and the secondary-side receiver 45. Specifically, the fourth pipe 26 connects a liquid side end (opposite to the gas side) of the secondary-side flow path 35*a* in the cascade heat exchanger 35 and the secondary-side receiver 45.

The secondary-side receiver 45 is a refrigerant vessel that reserves a residue refrigerant in the secondary-side refrigerant circuit 10. The fourth pipe 26, the fifth pipe 27, and the bypass circuit 46 are extended from the secondary-side receiver 45.

The bypass circuit 46 is a refrigerant pipe connecting a gas phase region which is an upper region in the secondary-side receiver 45 and the suction flow path 23. Specifically, the bypass circuit 46 is connected between the secondary-side switching mechanism 22 and the secondary-side accumulator 30 on the suction flow path 23. The bypass circuit 46 is provided with the bypass expansion valve 46*a*. The bypass expansion valve 46*a* is an electrically powered expansion valve that can adjust a quantity of the refrigerant guided from inside the secondary-side receiver 45 to the suction side of the secondary-side compressor 21 by adjusting an opening degree.

The fifth pipe 27 is a refrigerant pipe connecting the secondary-side receiver 45 and the third shutoff valve 31.

The secondary-side subcooling circuit 48 is a refrigerant pipe connecting a part of the fifth pipe 27 and the suction flow path 23. Specifically, the secondary-side subcooling circuit 48 is connected between the secondary-side switching mechanism 22 and the secondary-side accumulator 30 on the suction flow path 23. In the present embodiment, the secondary-side subcooling circuit 48 extends to branch from a portion between the secondary-side receiver 45 and the secondary-side subcooling heat exchanger 47.

The secondary-side subcooling heat exchanger 47 is a heat exchanger that causes heat exchange between the refrigerant flowing in a flow path belonging to the fifth pipe 27 and the refrigerant flowing in a flow path belonging to the secondary-side subcooling circuit 48. In the present embodiment, the secondary-side subcooling heat exchanger 47 is provided between a portion from where the secondary-side subcooling circuit 48 branches and the third shutoff valve 31 on the fifth pipe 27. The secondary-side subcooling expansion valve 48*a* is provided between a portion branching from the fifth pipe 27 and the secondary-side subcooling heat exchanger 47 on the secondary-side subcooling circuit 48. The secondary-side subcooling expansion valve 48*a* is an electrically powered expansion valve that has an adjustable opening degree and supplies the secondary-side subcooling heat exchanger 47 with a decompressed refrigerant.

The secondary-side accumulator 30 is a vessel that can reserve the secondary-side refrigerant, and is provided on the suction side of the secondary-side compressor 21.

The oil separator 34 is provided at a halfway portion of the discharge flow path 24. The oil separator 34 is a device for separating refrigerating machine oil discharged from the secondary-side compressor 21 along with the secondary-side refrigerant from the secondary-side refrigerant and return the refrigerating machine oil to the secondary-side compressor 21.

The oil return circuit 40 is provided to connect the oil separator 34 and the suction flow path 23. The oil return circuit 40 includes an oil return flow path 41 which is a flow path extending from the oil separator 34 and extending to join a portion between the secondary-side accumulator 30 and the suction side of the secondary-side compressor 21 on the suction flow path 23. An oil return capillary tube 42 and an oil return on-off valve 44 are provided at a halfway portion of the oil return flow path 41. When the oil return on-off valve 44 is controlled into an opened state, the refrigerating machine oil separated in the oil separator 34 passes through the oil return capillary tube 42 on the oil return flow path 41 and is returned to the suction side of the secondary-side compressor 21. In the present embodiment, when the secondary-side compressor 21 is in an operating state on the secondary-side refrigerant circuit 10, the oil return on-off valve 44 is kept in the opened state for predetermined time and is kept in a closed state for predetermined time repetitively, to control a returned quantity of the refrigerating machine oil through the oil return circuit 40. In the present embodiment, the oil return on-off valve 44 is an electromagnetic valve controlled to be opened and closed. Alternatively, the oil return on-off valve 44 may be an electrically powered expansion valve having an adjustable opening degree and not provided with the oil return capillary tube 42.

Hereinafter, the utilization circuits 13*a*, 13*b*, and 13*c* will be described. Since the utilization circuits 13*b* and 13*c* are configured similarly to the utilization circuit 13*a*, elements of the utilization circuits 13*b* and 13*c* will not be described repeatedly, assuming that a subscript "b" or "c" will replace a subscript "a" in reference signs denoting elements of the utilization circuit 13*a*.

The utilization circuit 13*a* principally includes a utilization-side heat exchanger 52*a*, a first utilization pipe 57*a*, a second utilization pipe 56*a*, and a utilization-side expansion valve 51*a*.

The utilization-side heat exchanger 52*a* is a device for causing heat exchange between a refrigerant and indoor air, and includes, for example, a fin-and-tube heat exchanger including a large number of heat transfer tubes and fins. The plurality of utilization-side heat exchangers 52*a*, 52*b*, and 52*c* are connected in parallel to the secondary-side switching mechanism 22, the suction flow path 23, and the cascade heat exchanger 35.

The second utilization pipe 56*a* has one end connected to a liquid side (opposite to a gas side) of the utilization-side heat exchanger 52*a* in the first utilization unit 3*a*. The other end of the second utilization pipe 56*a* is connected to the second connecting tube 16*a*. The utilization-side expansion valve 51*a* described above is provided at a halfway portion of the second utilization pipe 56*a*.

The utilization-side expansion valve 51*a* is an electrically powered expansion valve that has an adjustable opening degree for adjusting a flow rate of the refrigerant flowing in the utilization-side heat exchanger 52*a*. The utilization-side expansion valve 51*a* is provided on the second utilization pipe 56*a*.

The first utilization pipe 57*a* has one end connected to the gas side of the utilization-side heat exchanger 52*a* in the first utilization unit 3*a*. In the present embodiment, the first utilization pipe 57*a* is connected to a portion opposite to the utilization-side expansion valve 51*a* of the utilization-side heat exchanger 52*a*. The first utilization pipe 57*a* has the other end connected to the first connecting tube 15*a*.

Hereinafter, the branch circuits 14*a*, 14*b*, and 14*c* will be described. Since the branch circuits 14*b* and 14*c* are configured similarly to the branch circuit 14*a*, elements of the branch circuits 14*b* and 14*c* will not be described repeatedly, assuming that a subscript "b" or "c" will replace a subscript "a" in reference signs denoting elements of the branch circuit 14*a*.

The branch circuit 14*a* mainly includes a junction pipe 62*a*, a first branch pipe 63*a*, a second branch pipe 64*a*, a first regulating valve 66*a*, a second regulating valve 67*a*, a bypass pipe 69*a*, a check valve 68*a*, and a third branch pipe 61*a*.

The junction pipe 62*a* has one end connected to the first connecting tube 15*a*. The junction pipe 62*a* has the other end branched to be connected with the first branch pipe 63*a* and the second branch pipe 64*a*.

The first branch pipe 63*a* has a portion opposite to the junction pipe 62 and connected to the secondary-side first connection pipe 8. The first branch pipe 63*a* is provided with the openable and closable first regulating valve 66*a*.

The second branch pipe 64*a* has a portion opposite to the junction pipe 62 and connected to the secondary-side second connection pipe 9. The second branch pipe 64*a* is provided with the openable and closable second regulating valve 67*a*.

The bypass pipe 69*a* is a refrigerant pipe that connects a portion of the first branch pipe 63*a* closer to the secondary-side first connection pipe 8 than the first regulating valve 66*a* and a portion of the second branch pipe 64*a* closer to the secondary-side second connection pipe 9 than the second regulating valve 67*a*. The check valve 68*a* is provided at a halfway portion of the bypass pipe 69*a*. The check valve 68*a* allows only a refrigerant flow from the second branch pipe 64*a* toward the first branch pipe 63*a*, and does not allow a refrigerant flow from the first branch pipe 63*a* toward the second branch pipe 64*a*.

The third branch pipe 61*a* has one end connected to the second connecting tube 16*a*. The other end of the third branch pipe 61*a* is connected to the secondary-side third connection pipe 7.

The first branch unit 6*a* can function as follows by closing the first regulating valve 66*a* and opening the second regulating valve 67*a* when the cooling operation described later is performed. The first branch unit 6*a* sends a refrigerant flowing into the third branch pipe 61*a* through the secondary-side third connection pipe 7 to the second connecting tube 16*a*. The refrigerant flowing in the second utilization pipe 56*a* in the first utilization unit 3*a* through the second connecting tube 16*a* is sent to the utilization-side heat exchanger 52*a* in the first utilization unit 3*a* through the utilization-side expansion valve 51*a*. The refrigerant sent to the utilization-side heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* does not flow toward the first branch pipe 63*a* but flows toward the second branch pipe 64*a*. The refrigerant flowing in the second branch pipe 64*a* passes through the second regulating valve 67*a*. A part of the refrigerant that has passed through the second regulating valve 67*a* is sent to the secondary-side second connection pipe 9. The remaining part of the refrigerant that has passed through the second regulating valve 67*a* flows so as to branch into the bypass pipe 69*a* provided with the check valve 68*a*, passes through a part of the first branch pipe 63*a*, and then is sent to the secondary-side first connection pipe 8. As a result, it is possible to increase a total flow path sectional area when the secondary-side refrigerant in a gas state evaporated in the utilization-side heat exchanger 52*a* is sent to the secondary-side compressor 21, so that a pressure loss can be reduced.

When the first utilization unit 3*a* cools an indoor space at the time of performing the cooling main operation and the heating main operation described later, the first branch unit 6*a* can function as follows by closing the first regulating valve 66*a* and opening the second regulating valve 67*a*. The first branch unit 6*a* sends a refrigerant flowing into the third branch pipe 61*a* through the secondary-side third connection pipe 7 to the second connecting tube 16*a*. The refrigerant flowing in the second utilization pipe 56*a* in the first utilization unit 3*a* through the second connecting tube 16*a* is sent to the utilization-side heat exchanger 52*a* in the first utilization unit 3*a* through the utilization-side expansion valve 51*a*. The refrigerant sent to the utilization-side heat exchanger 52*a* is evaporated by heat exchange with indoor air, and then flows in the first connecting tube 15*a* via the first utilization pipe 57*a*. The refrigerant having flowed through the first connecting tube 15*a* is sent to the junction pipe 62*a* of the first branch unit 6*a*. The refrigerant having flowed through the junction pipe 62*a* flows to the second branch pipe 64*a*, passes through the second regulating valve 67*a*, and then is sent to the secondary-side second connection pipe 9.

The first branch unit 6*a* can function as follows by closing the second regulating valve 67*a* and opening the first regulating valve 66*a* when the heating operation described later is performed. In the first branch unit 6*a*, the refrigerant flowing into the first branch pipe 63*a* through the secondary-side first connection pipe 8 passes through the first regulating valve 66*a* and is sent to the junction pipe 62*a*. The refrigerant having flowed through the junction pipe 62*a* flows in the first utilization pipe 57*a* in the utilization unit 3*a* via the first connecting tube 15*a* and is sent to the utilization-side heat exchanger 52*a*. The refrigerant sent to the utilization-side heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and then is sent to the secondary-side third connection pipe 7.

When the first utilization unit 3*a* heats an indoor space at the time of performing the cooling main operation and the heating main operation described later, the first branch unit 6*a* can function as follows by closing the second regulating valve 67*a* and opening the first regulating valve 66*a*. In the first branch unit 6*a*, the refrigerant flowing into the first branch pipe 63*a* through the secondary-side first connection pipe 8 passes through the first regulating valve 66*a* and is sent to the junction pipe 62*a*. The refrigerant having flowed through the junction pipe 62*a* flows in the first utilization pipe 57*a* in the utilization unit 3*a* via the first connecting tube 15*a* and is sent to the utilization-side heat exchanger 52*a*. The refrigerant sent to the utilization-side heat exchanger 52*a* radiates heat through heat exchange with indoor air, and then passes through the utilization-side expansion valve 51*a* provided on the second utilization pipe 56*a*. The refrigerant having passed through the second utilization pipe 56*a* flows through the third branch pipe 61*a* of the first branch unit 6*a* via the second connecting tube 16*a*, and then is sent to the secondary-side third connection pipe 7.

The first branch unit 6*a*, as well as the second branch unit 6*b* and the third branch unit 6*c*, similarly have such a function. Accordingly, the first branch unit 6*a*, the second branch unit 6*b*, and the third branch unit 6*c* can individually switchably cause the utilization-side heat exchangers 52*a*, 52*b*, and 52*c* to function as a refrigerant evaporator or a refrigerant radiator.

(4) Primary-Side Unit

The primary-side unit 5 is disposed in a space different from a space provided with the utilization units 3*a*, 3*b*, and 3*c* and the branch units 6*a*, 6*b*, and 6*c*, on a roof, or the like.

The primary-side unit 5 includes a part of the primary-side refrigerant circuit 5*a* described above, a primary-side fan 75, various sensors, and a primary-side control unit 70, and a primary-side casing (not illustrated).

The primary-side unit 5 includes, as a part of the primary-side refrigerant circuit 5*a*, the primary-side compressor 71, the primary-side switching mechanism 72, the primary-side heat exchanger 74, the primary-side first expansion valve 76, the primary-side subcooling heat exchanger 103, the primary-side subcooling circuit 104, the primary-side subcooling expansion valve 104*a*, the first liquid shutoff valve 108, the first gas shutoff valve 109, and the primary-side accumulator 105 in the primary-side casing.

The primary-side fan 75 is provided in the primary-side unit 5, and generates an air flow of guiding outdoor air into the primary-side heat exchanger 74, and exhausting, to outdoors, air obtained after heat exchange with the primary-side refrigerant flowing in the primary-side heat exchanger 74. The primary-side fan 75 is driven by a primary-side fan motor 75*a*.

The primary-side unit 5 is provided with the various sensors. Specifically, there are provided an outdoor air temperature sensor 77 that detects a temperature of outdoor air before passing through the primary-side heat exchanger 74, a primary-side discharge pressure sensor 78 that detects a pressure of the primary-side refrigerant discharged from the primary-side compressor 71, a primary-side suction pressure sensor 79 that detects a pressure of the primary-side refrigerant sucked into the primary-side compressor 71, a primary-side suction temperature sensor 81 that detects a temperature of the primary-side refrigerant sucked into the primary-side compressor 71, and a primary-side heat exchange temperature sensor 82 that detects a temperature of the refrigerant flowing in the primary-side heat exchanger 74.

The primary-side control unit 70 controls motion of the elements 71 (71*a*), 72, 75 (75*a*), 76, and 104*a* provided in the primary-side unit 5. The primary-side control unit 70 includes a processor such as a CPU or a microcomputer provided to control the primary-side unit 5 and a memory, so as to transmit and receive control signals and the like to and from a remote controller (not illustrated), and to transmit and receive control signals and the like between a cascade-side control unit 20 in a cascade unit 2, branch unit control units 60*a*, 60*b*, and 60*c*, and utilization-side control units 50*a*, 50*b*, and 50*c*.

(5) Cascade Unit

The cascade unit 2 is disposed in a space different from a space provided with the utilization units 3*a*, 3*b*, and 3*c* and the branch units 6*a*, 6*b*, and 6*c*, on a roof, or the like.

The cascade unit 2 is connected to the branch units 6*a*, 6*b*, and 6*c* via the connection pipes 7, 8, and 9, to constitute a part of the secondary-side refrigerant circuit 10. The cascade unit 2 is connected to the primary-side unit 5 via the primary-side first connection pipe 111 and the primary-side second connection pipe 112, to constitute a part of the primary-side refrigerant circuit 5*a*.

The cascade unit 2 mainly includes the cascade circuit 12 described above, various sensors, the cascade-side control unit 20, and the second liquid shutoff valve 106, the second refrigerant pipe 114, the primary-side second expansion valve 102, the first refrigerant pipe 113, and the second gas shutoff valve 107 that constitute a part of the primary-side refrigerant circuit 5*a*, the cascade casing (not illustrated), and the like.

The cascade unit 2 is provided with a secondary-side suction pressure sensor 37 that detects a pressure of the secondary-side refrigerant on the suction side of the secondary-side compressor 21, a secondary-side discharge pressure sensor 38 that detects a pressure of the secondary-side refrigerant on the discharge side of the secondary-side compressor 21, a secondary-side discharge temperature sensor 39 that detects a temperature of the secondary-side refrigerant on the discharge side of the secondary-side compressor 21, a secondary-side suction temperature sensor 88 that detects a temperature of the secondary-side refrigerant on the suction side of the secondary-side compressor 21, a secondary-side cascade temperature sensor 83 that detects a temperature of the secondary-side refrigerant flowing between the secondary-side flow path 35*a* of the cascade heat exchanger 35 and the cascade expansion valve 36, a receiver outlet temperature sensor 84 that detects a temperature of the secondary-side refrigerant flowing between the secondary-side receiver 45 and the secondary-side subcooling heat exchanger 47, a bypass circuit temperature sensor 85 that detects a temperature of the secondary-side refrigerant flowing downstream of the bypass expansion valve 46*a* in the bypass circuit 46, a subcooling outlet temperature sensor 86 that detects a temperature of the secondary-side refrigerant flowing between the secondary-side subcooling heat exchanger 47 and the third shutoff valve 31, and a subcooling circuit temperature sensor 87 that detects a temperature of the secondary-side refrigerant flowing at an outlet of the secondary-side subcooling heat exchanger 47 in the secondary-side subcooling circuit 48.

The cascade-side control unit 20 controls motion of the elements 21 (21*a*), 22, 36, 44, 46*a*, 48*a*, and 102 provided in the cascade casing of the cascade unit 2. The cascade-side control unit 20 includes a processor such as a CPU or a microcomputer provided to control the cascade unit 2 and a memory, so as to transmit and receive control signals and the like between the primary-side control unit 70 in the primary-side unit 5, the utilization-side control units 50*a*, 50*b*, and 50*c* in the utilization units 3*a*, 3*b*, and 3*c*, and the branch unit control units 60*a*, 60*b*, and 60*c*.

In such a manner, the cascade-side control unit 20 can control not only the elements constituting the cascade circuit 12 of the secondary-side refrigerant circuit 10 but also the primary-side second expansion valve 102 constituting a part of the primary-side refrigerant circuit 5*a*. Therefore, the cascade-side control unit 20 controls a valve opening degree of the primary-side second expansion valve 102 on the basis of a condition of the cascade circuit 12 controlled by the cascade-side control unit 20, so as to bring the condition of the cascade circuit 12 closer to a desired condition. Specifically, it is possible to control an amount of heat received by the secondary-side refrigerant flowing in the secondary-side flow path 35*a* of the cascade heat exchanger 35 in the cascade circuit 12 from the primary-side refrigerant flowing in the primary-side flow path 35*b* of the cascade heat exchanger 35 or an amount of heat given by the secondary-side refrigerant to the primary-side refrigerant.

(6) Utilization Unit

The utilization units 3*a*, 3*b*, and 3*c* are installed by being embedded in or being suspended from a ceiling on an indoor space of a building or the like, or by being hung on a wall surface in the indoor space, or the like.

The utilization units 3*a*, 3*b*, and 3*c* are connected to the cascade unit 2 via the connection pipes 7, 8, and 9.

The utilization units 3*a*, 3*b*, and 3*c* respectively include the utilization circuits 13*a*, 13*b*, and 13*c* constituting a part of the secondary-side refrigerant circuit 10.

Hereinafter, the utilization units 3*a*, 3*b*, and 3*c* will be described in terms of their configurations. The second utilization unit 3*b* and the third utilization unit 3*c* are configured similarly to the first utilization unit 3*a*. The configuration of only the first utilization unit 3*a* will thus be described here. As for the configuration of each of the second utilization unit 3*b* and the third utilization unit 3*c*, elements will be denoted by reference signs obtained by replacing a subscript "a" in reference signs of elements of the first utilization unit 3*a* with a subscript "b" or "c", and these elements will not be described repeatedly.

The first utilization unit 3*a* mainly includes the utilization circuit 13*a* described above, an indoor fan 53*a*, the utilization-side control unit 50*a*, and various sensors. Note that the indoor fan 53*a* includes an indoor fan motor 54*a*.

The indoor fan 53*a* generates an air flow by sucking indoor air into the unit and supplying the indoor space with supply air obtained after heat exchange with the refrigerant flowing in the utilization-side heat exchanger 52*a*. The indoor fan 53*a* is driven by the indoor fan motor 54*a*.

The utilization unit 3*a* is provided with a liquid-side temperature sensor 58*a* that detects a temperature of a refrigerant on the liquid side of the utilization-side heat exchanger 52*a*. The utilization unit 3*a* is further provided with an indoor temperature sensor 55*a* that detects an indoor temperature as temperature of air introduced from the indoor space before passing through the utilization-side heat exchanger 52*a*.

The utilization-side control unit 50*a* controls motion of the elements 51*a* and 53*a* (54*a*) constituting the utilization unit 3*a*. The utilization-side control unit 50*a* includes a processor such as a CPU or a microcomputer provided to control the utilization unit 3*a* and a memory, so as to transmit and receive control signals and the like to and from the remote controller (not illustrated), and to transmit and receive control signals and the like between the cascade-side control unit 20 in the cascade unit 2, the branch unit control units 60*a*, 60*b*, and 60*c*, and the primary-side control unit 70 in the primary-side unit 5.

Note that the second utilization unit 3*b* includes the utilization circuit 13*b*, an indoor fan 53*b*, the utilization-side control unit 50*b*, and an indoor fan motor 54*b*. The third utilization unit 3*c* includes the utilization circuit 13*c*, an indoor fan 53*c*, the utilization-side control unit 50*c*, and an indoor fan motor 54*c*.

(7) Branch Unit

The branch units 6*a*, 6*b*, and 6*c* are installed in a space above a ceiling of an indoor space of a building or the like.

Each of the branch units 6*a*, 6*b*, and 6*c* is connected to a corresponding one of the utilization units 3*a*, 3*b*, and 3*c* one by one. The branch units 6*a*, 6*b*, and 6*c* are connected to the cascade unit 2 via the connection pipes 7, 8, and 9.

Next, the branch units 6*a*, 6*b*, and 6*c* will be described next in terms of their configurations. The second branch unit 6*b* and the third branch unit 6*c* are configured similarly to the first branch unit 6*a*. The configuration of only the first branch unit 6*a* will thus be described here. As for the configuration of each of the second branch unit 6*b* and the third branch unit 6*c*, elements will be denoted by reference signs obtained by replacing a subscript "a" in reference signs of elements of the first branch unit 6*a* with a subscript "b" or "c", and these elements will not be described repeatedly.

The first branch unit 6*a* mainly includes the branch circuit 14*a* described above and the branch unit control unit 60*a*.

The branch unit control unit 60*a* controls motion of the elements 66*a* and 67*a* constituting the branch unit 6*a*. The branch unit control unit 60*a* includes a processor such as a CPU or a microcomputer provided to control the branch unit 6*a* and a memory, so as to transmit and receive control signals and the like to and from the remote controller (not depicted), and to transmit and receive control signals and the like between the cascade-side control unit 20 in the cascade unit 2, the utilization units 3*a*, 3*b*, and 3*c*, and the primary-side control unit 70 in the primary-side unit 5.

Note that the second branch unit 6*b* includes the branch circuit 14*b* and the branch unit control unit 60*b*. The third branch unit 6*c* includes the branch circuit 14*c* and the branch unit control unit 60*c*.

(8) Control Unit

In the refrigeration cycle apparatus 1, the cascade-side control unit 20, the utilization-side control units 50*a*, 50*b*, and 50*c*, the branch unit control units 60*a*, 60*b*, and 60*c*, and the primary-side control unit 70 described above are communicably connected to each other in a wired or wireless manner to constitute a control unit 80. Therefore, the control unit 80 controls motion of the elements 21(21*a*), 22, 36, 44, 46*a*, 48*a*, 51*a*, 51*b*, 51*c*, 53*a*, 53*b*, 53*c* (54*a*, 54*b*, 54*c*), 66*a*, 66*b*, 66*c*, 67*a*, 67*b*, 67*c*, 71 (71*a*), 72, 75 (75*a*), 76, 104*a* on the basis of detection information of various sensors 37, 38, 39, 83, 84, 85, 86, 87, 88, 77, 78, 79, 81, 82, 58*a*, 58*b*, 58*c*, and the like, and instruction information received from a remote controller (not illustrated) and the like.

(9) Motion of Refrigeration Cycle Apparatus

Next, motion of the refrigeration cycle apparatus 1 will be described with reference to FIGS. 3 to 6.

The refrigeration cycle operation of the refrigeration cycle apparatus 1 can be mainly divided into cooling operation, heating operation, cooling main operation, and heating main operation.

Here, the cooling operation is refrigeration cycle operation in which only the utilization unit in which the utilization-side heat exchanger functions as a refrigerant evaporator exists, and the cascade heat exchanger 35 functions as a radiator for the secondary-side refrigerant with respect to an evaporation load of the entire utilization unit.

Here, the heating operation is refrigeration cycle operation in which only the utilization unit in which the utilization-side heat exchanger functions as a refrigerant radiator exists, and the cascade heat exchanger 35 functions as an evaporator for the secondary-side refrigerant with respect to a radiation load of the entire utilization unit.

The cooling main operation is operation in which the utilization unit in which the utilization-side heat exchanger functions as a refrigerant evaporator and the utilization unit in which the utilization-side heat exchanger functions as a refrigerant radiator are mixed. The cooling main operation is refrigeration cycle operation in which, when an evaporation load is a main heat load of the entire utilization unit, the cascade heat exchanger 35 functions as a radiator for the secondary-side refrigerant in order to process the evaporation load of the entire utilization unit.

The heating main operation is operation in which the utilization unit in which the utilization-side heat exchanger functions as a refrigerant evaporator and the utilization unit in which the utilization-side heat exchanger functions as a refrigerant radiator are mixed. The heating main operation is refrigeration cycle operation in which, when a radiation load is a main heat load of the entire utilization unit, the cascade heat exchanger 35 functions as an evaporator for the secondary-side refrigerant in order to process the radiation load of the entire utilization unit.

Note that the motion of the refrigeration cycle apparatus 1 including the refrigeration cycle operation is performed by the control unit 80 described above.

(9-1) Cooling Operation

Figure 3:
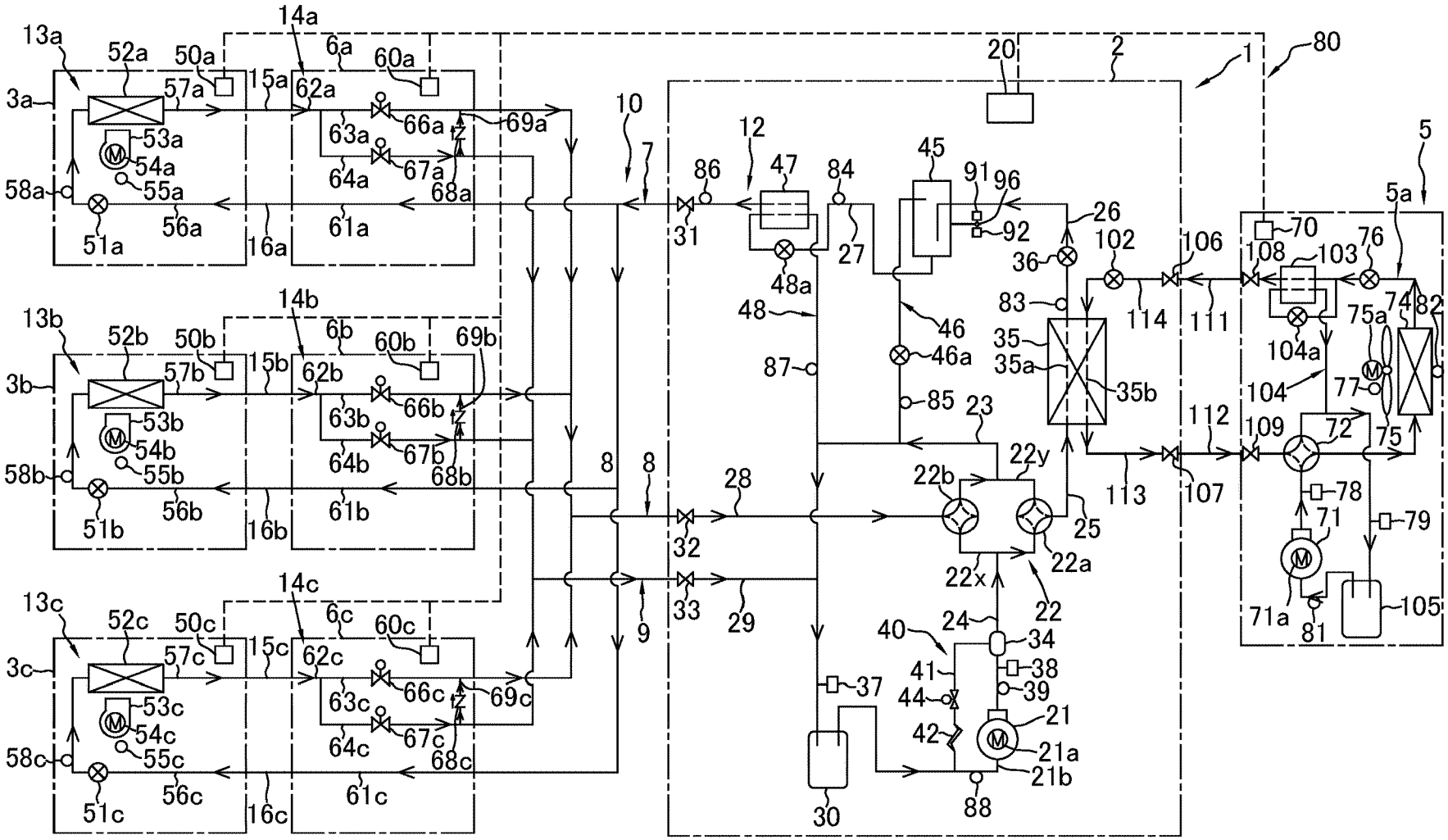
FIG. 3 is a diagram illustrating motion (a flow of a refrigerant) in cooling operation of the refrigeration cycle apparatus.

During the cooling operation, for example, each of the utilization-side heat exchangers 52*a*, 52*b*, and 52*c* in the utilization units 3*a*, 3*b*, and 3*c* functions as a refrigerant evaporator, and the cascade heat exchanger 35 functions as a radiator for the secondary-side refrigerant. In the cooling operation, the primary-side refrigerant circuit 5*a* and the secondary-side refrigerant circuit 10 of the refrigeration cycle apparatus 1 are configured as illustrated in FIG. 3. Note that arrows attached to the primary-side refrigerant circuit 5*a* and arrows attached to the secondary-side refrigerant circuit 10 in FIG. 3 indicate flows of the refrigerant during the cooling operation.

Specifically, in the primary-side unit 5, the primary-side switching mechanism 72 is switched to the fifth connection state to cause the cascade heat exchanger 35 to function as an evaporator for the primary-side refrigerant. The fifth connection state of the primary-side switching mechanism 72 is depicted by solid lines in the primary-side switching mechanism 72 in FIG. 3. Accordingly, in the primary-side unit 5, the primary-side refrigerant discharged from the primary-side compressor 71 passes through the primary-side switching mechanism 72 and exchanges heat with outdoor air supplied from the primary-side fan 75 in the primary-side heat exchanger 74 to be condensed. The primary-side refrigerant condensed in the primary-side heat exchanger 74 passes through the primary-side first expansion valve 76 controlled into a fully opened state, and a part of the refrigerant flows toward the first liquid shutoff valve 108 through the primary-side subcooling heat exchanger 103, and another part of the refrigerant branches into the primary-side subcooling circuit 104. The refrigerant flowing in the primary-side subcooling circuit 104 is decompressed when passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing in the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in that order, and is decompressed when passing through the primary-side second expansion valve 102. Here, a valve opening degree of the primary-side second expansion valve 102 is controlled such that a degree of superheating of the primary-side refrigerant sucked into the primary-side compressor 71 satisfies a predetermined condition. When flowing in the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant having passed through the primary-side switching mechanism 72 joins the refrigerant having flowed through the primary-side subcooling circuit 104, and is then sucked into the primary-side compressor 71 via the primary-side accumulator 105.

In the cascade unit 2, by switching the secondary-side switching mechanism 22 to the first connection state, the cascade heat exchanger 35 functions as a radiator for the secondary-side refrigerant. In the first connection state of the secondary-side switching mechanism 22, the discharge flow path 24 and the third pipe 25 are connected by the first switching valve 22*a*, and the first pipe 28 and the suction flow path 23 are connected by the second switching valve 22*b*. In the first to third utilization units 3*a*, 3*b*, 3*c*, the second regulating valves 67*a*, 67*b*, 67*c* are controlled to the opened state. Accordingly, all of the utilization-side heat exchangers 52*a*, 52*b*, and 52*c* in the utilization units 3*a*, 3*b*, and 3*c* function as refrigerant evaporators. All of the utilization-side heat exchangers 52*a*, 52*b*, and 52*c* of the utilization units 3*a*, 3*b*, and 3*c* and the suction side of the secondary-side compressor 21 of the cascade unit 2 are connected via the first utilization pipes 57*a*, 57*b*, and 57*c*, the first connecting tubes 15*a*, 15*b*, and 15*c*, the junction pipes 62*a*, 62*b*, and 62*c*, the second branch pipes 64*a*, 64*b*, and 64*c*, the bypass pipes 69*a*, 69*b*, and 69*c*, a part of the first branch pipes 63*a*, 63*b*, and 63*c*, the secondary-side first connection pipe 8, and the secondary-side second connection pipe 9. In addition, an opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled to the closed state. In the utilization units 3*a*, 3*b*, and 3*c*, the opening degrees of the utilization-side expansion valves 51*a*, 51*b*, and 51*c* are adjusted.

In the cooling operation, the secondary-side refrigerant circuit 10 controls capacity, for example, by controlling a frequency of the secondary-side compressor 21 so that evaporation temperature of the secondary-side refrigerant in the utilization-side heat exchangers 52*a*, 52*b*, and 52*c* becomes a predetermined secondary-side evaporation target temperature. The opening degree of the cascade expansion valve 36 is adjusted such that the secondary-side refrigerant flowing in the cascade heat exchanger 35 has a critical pressure or less. The primary-side refrigerant circuit 5*a* controls capacity, for example, by controlling a frequency of the primary-side compressor 71 such that evaporation temperature of the primary-side refrigerant in the primary-side flow path 35*b* of the cascade heat exchanger 35 becomes a predetermined primary-side evaporation target temperature. In such a manner, in the cooling operation, either or both of the control for increasing the valve opening degree of the cascade expansion valve 36 and the control for increasing the frequency of the primary-side compressor 71 in the primary-side refrigerant circuit 5*a* are executed, and thus, the carbon dioxide refrigerant flowing in the cascade heat exchanger 35 is controlled so as not to exceed a critical point.

In such a secondary-side refrigerant circuit 10, a secondary-side high-pressure refrigerant compressed and discharged by the secondary-side compressor 21 is sent to the secondary-side flow path 35*a* of the cascade heat exchanger 35 through the first switching valve 22*a* of the secondary-side switching mechanism 22. The secondary-side high-pressure refrigerant flowing in the secondary-side flow path 35*a* of the cascade heat exchanger 35 radiates heat, and the primary-side refrigerant flowing in the primary-side flow path 35*b* of the cascade heat exchanger 35 is evaporated. The secondary-side refrigerant having radiated heat in the cascade heat exchanger 35 passes through the cascade expansion valve 36 whose opening degree is adjusted, and then flows into the secondary-side receiver 45. A part of the refrigerant flowing out of the secondary-side receiver 45 branches and flows into the secondary-side subcooling circuit 48, is decompressed in the secondary-side subcooling expansion valve 48*a*, and then joins the suction flow path 23. In the secondary-side subcooling heat exchanger 47, another part of the refrigerant having flowed out of the secondary-side receiver 45 is cooled by the refrigerant flowing in the secondary-side subcooling circuit 48, and is then sent to the secondary-side third connection pipe 7 through the third shutoff valve 31.

Then, the refrigerant sent to the secondary-side third connection pipe 7 is branched into three portions to pass through the third branch pipes 61*a*, 61*b*, and 61*c* of the first to third branch units 6*a*, 6*b*, and 6*c*. Thereafter, the refrigerant having flowed through the second connecting tubes 16*a*, 16*b*, and 16*c* is sent to the second utilization pipes 56*a*, 56*b*, and 56*c* of the first to third utilization units 3*a*, 3*b*, and 3*c*. The refrigerant sent to the second utilization pipes 56*a*, 56*b*, and 56*c* is sent to the utilization-side expansion valves 51*a*, 51*b*, and 51*c* in the utilization units 3*a*, 3*b*, and 3*c*.

Then, the refrigerant having passed through the utilization-side expansion valves 51*a*, 51*b*, and 51*c* whose opening degrees are adjusted exchanges heat with indoor air supplied by the indoor fans 53*a*, 53*b*, and 53*c* in the utilization-side heat exchangers 52*a*, 52*b*, and 52*c*. The refrigerant flowing in the utilization-side heat exchangers 52*a*, 52*b*, and 52*c* is thus evaporated into a low-pressure gas refrigerant. The indoor air is cooled and is supplied into the indoor space. The indoor space is thus cooled. The low-pressure gas refrigerant evaporated in the utilization-side heat exchangers 52*a*, 52*b*, and 52*c* flows in the first utilization pipes 57*a*, 57*b*, and 57*c*, flows through the first connecting tubes 15*a*, 15*b*, and 15*c*, and then is sent to the junction pipes 62*a*, 62*b*, and 62*c* of the first to third branch units 6*a*, 6*b*, and 6*c*.

Then, the low-pressure gas refrigerant sent to the junction pipes 62*a*, 62*b*, and 62*c* flows to the second branch pipes 64*a*, 64*b*, and 64*c*. A part of the refrigerant that has passed through the second regulating valves 67*a*, 67*b*, and 67*c* in the second branch pipes 64*a*, 64*b*, and 64*c* is sent to the secondary-side second connection pipe 9. The remaining part of the refrigerant that has passed through the second regulating valves 67*a*, 67*b*, and 67*c* passes through the bypass pipes 69*a*, 69*b*, and 69*c*, flows through a part of the first branch pipes 63*a*, 63*b*, and 63*c*, and then is sent to the secondary-side first connection pipe 8.

Then, the low-pressure gas refrigerant sent to the secondary-side first connection pipe 8 and the secondary-side second connection pipe 9 is returned to the suction side of the secondary-side compressor 21 through the first shutoff valve 32, the second shutoff valve 33, the first pipe 28, the second pipe 29, the second switching valve 22*b* of the secondary-side switching mechanism 22, the suction flow path 23, and the secondary-side accumulator 30.

Motion during the cooling operation is performed in such a manner.

(9-2) Heating Operation

Figure 4:
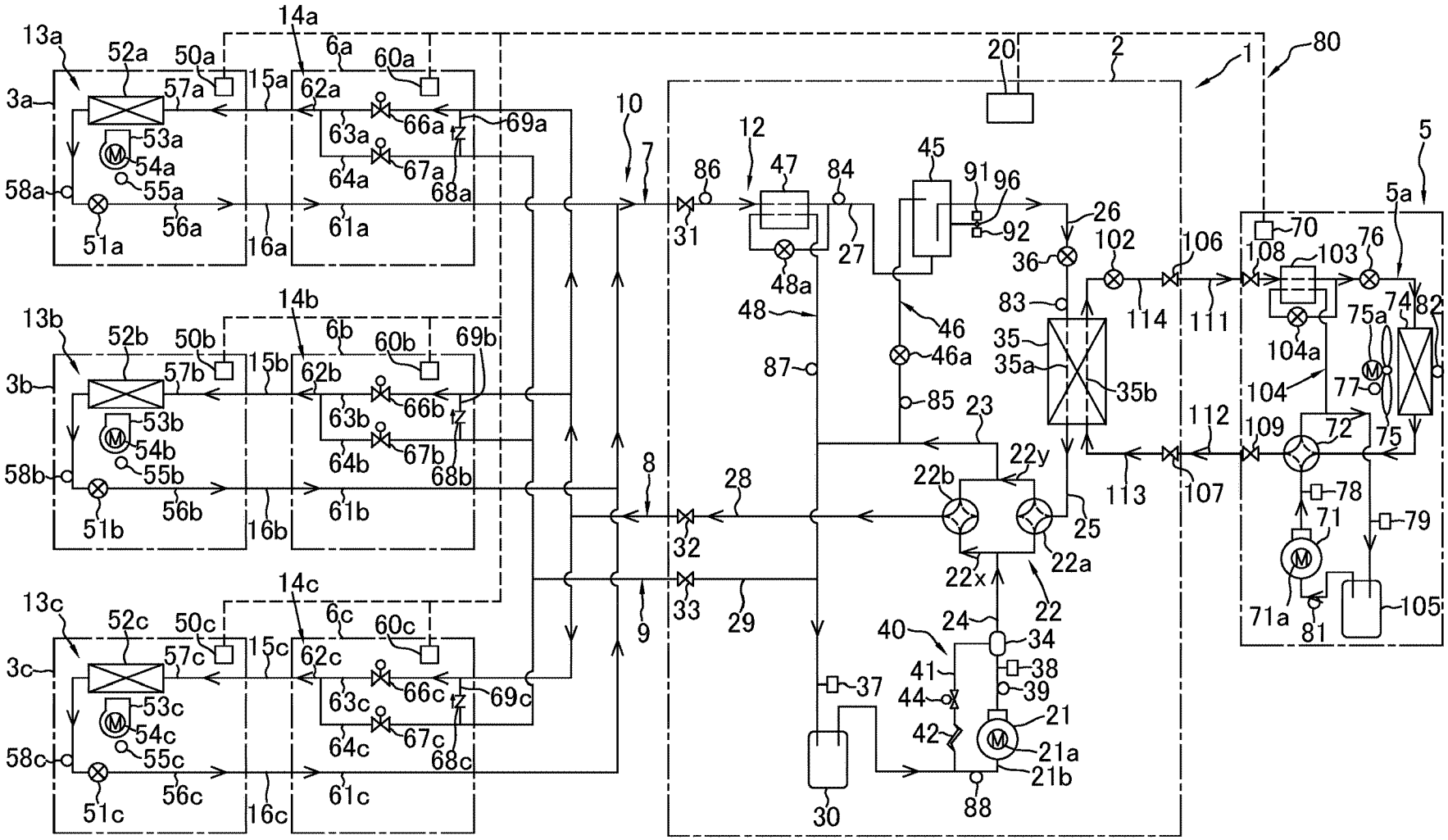
FIG. 4 is a diagram illustrating motion (a flow of a refrigerant) in heating operation of the refrigeration cycle apparatus.

During the heating operation, for example, each of the utilization-side heat exchangers 52*a*, 52*b*, and 52*c* in the utilization units 3*a*, 3*b*, and 3*c* functions as a refrigerant radiator. In the heating operation, the cascade heat exchanger 35 operates to function as an evaporator for the secondary-side refrigerant. In the heating operation, the primary-side refrigerant circuit 5*a* and the secondary-side refrigerant circuit 10 of the refrigeration cycle apparatus 1 are configured as illustrated in FIG. 4. Arrows attached to the primary-side refrigerant circuit 5*a* and arrows attached to the secondary-side refrigerant circuit 10 in FIG. 4 indicate flows of the refrigerant during the heating operation.

Specifically, in the primary-side unit 5, the primary-side switching mechanism 72 is switched to a sixth operating state to cause the cascade heat exchanger 35 to function as a radiator for the primary-side refrigerant. The sixth operating state of the primary-side switching mechanism 72 is a connection state depicted by broken lines in the primary-side switching mechanism 72 in FIG. 4. Accordingly, in the primary-side unit 5, the primary-side refrigerant discharged from the primary-side compressor 71, having passed through the primary-side switching mechanism 72 and the first gas shutoff valve 109 passes through the primary-side second connection pipe 112 and the second gas shutoff valve 107 and is sent to the primary-side flow path 35*b* of the cascade heat exchanger 35. The refrigerant flowing in the primary-side flow path 35*b* of the cascade heat exchanger 35 is condensed by exchanging heat with the secondary-side refrigerant flowing in the secondary-side flow path 35*a*. When flowing in the second refrigerant pipe 114, the primary-side refrigerant condensed in the cascade heat exchanger 35 passes through the primary-side second expansion valve 102 controlled to the fully opened state. The refrigerant that has passed through the primary-side second expansion valve 102 flows through the second liquid shutoff valve 106, the primary-side first connection pipe 111, the first liquid shutoff valve 108, and the primary-side subcooling heat exchanger 103 in that order, and is decompressed by the primary-side first expansion valve 76. During heating operation, the primary-side subcooling expansion valve 104*a* is controlled to the closed state. Accordingly, the refrigerant does not flow to the primary-side subcooling circuit 104 and does not exchange heat in the primary-side subcooling heat exchanger 103. The valve opening degree of the primary-side first expansion valve 76 is controlled such that, for example, the degree of superheating of the refrigerant sucked into the primary-side compressor 71 satisfies a predetermined condition. The refrigerant decompressed by the primary-side first expansion valve 76 evaporates by exchanging heat with outdoor air supplied from the primary-side fan 75 in the primary-side heat exchanger 74, passes through the primary-side switching mechanism 72 and the primary-side accumulator 105, and is sucked into the primary-side compressor 71.

In the cascade unit 2, the secondary-side switching mechanism 22 is switched to the second connection state. The cascade heat exchanger 35 thus functions as an evaporator for the secondary-side refrigerant. In the second connection state of the secondary-side switching mechanism 22, the discharge flow path 24 and the first pipe 28 are connected by the second switching valve 22*b*, and the third pipe 25 and the suction flow path 23 are connected by the first switching valve 22*a*. The opening degree of the cascade expansion valve 36 is adjusted. In the first to third branch units 6*a*, 6*b*, and 6*c*, the first regulating valves 66*a*, 66*b*, and 66*c* are controlled to the opened state, and the second regulating valves 67*a*, 67*b*, and 67*c* are controlled to the closed state. Accordingly, all of the utilization-side heat exchangers 52*a*, 52*b*, and 52*c* in the utilization units 3*a*, 3*b*, and 3*c* function as refrigerant radiators. The utilization-side heat exchangers 52*a*, 52*b*, and 52*c* in the utilization units 3*a*, 3*b*, and 3*c* and the discharge side of the secondary-side compressor 21 in the cascade unit 2 are connected via the discharge flow path 24, the first pipe 28, the secondary-side first connection pipe 8, the first branch pipes 63*a*, 63*b*, and 63*c*, the junction pipes 62*a*, 62*b*, and 62*c*, the first connecting tubes 15*a*, 15*b*, and 15*c*, and the first utilization pipes 57*a*, 57*b*, and 57*c*. The secondary-side subcooling expansion valve 48*a* and the bypass expansion valve 46*a* are controlled to the closed state. In the utilization units 3*a*, 3*b*, and 3*c*, the opening degrees of the utilization-side expansion valves 51*a*, 51*b*, and 51*c* are adjusted.

During the heating operation, the secondary-side refrigerant circuit 10 controls capacity on the secondary-side compressor 21 so as to achieve a frequency at which the loads in the utilization-side heat exchangers 52*a*, 52*b*, and 52*c* can be processed. As a result, in the heating operation, the secondary-side refrigerant discharged from the secondary-side compressor 21 is controlled to be in a critical state exceeding the critical pressure. The primary-side refrigerant circuit 5*a* controls capacity, for example, by controlling the frequency of the primary-side compressor 71 such that condensation temperature of the primary-side refrigerant in the primary-side flow path 35*b* of the cascade heat exchanger 35 becomes a predetermined primary-side condensation target temperature.

In such a secondary-side refrigerant circuit 10, the high-pressure refrigerant compressed and discharged by the secondary-side compressor 21 is sent to the first pipe 28 through the second switching valve 22*b* of the secondary-side switching mechanism 22. The refrigerant sent to the first pipe 28 is sent to the secondary-side first connection pipe 8 through the first shutoff valve 32.

Then, the high-pressure refrigerant sent to the secondary-side first connection pipe 8 is branched into three portions to be sent to the first branch pipes 63*a*, 63*b*, and 63*c* in the utilization units 3*a*, 3*b*, and 3*c* which are utilization units in operation. The high-pressure refrigerant sent to the first branch pipes 63*a*, 63*b*, and 63*c* passes through the first regulating valves 66*a*, 66*b*, and 66*c*, and flows in the junction pipes 62*a*, 62*b*, and 62*c*. Thereafter, the refrigerant having flowed in the first connecting tubes 15*a*, 15*b*, and 15*c* and the first utilization pipes 57*a*, 57*b*, and 57*c* is sent to the utilization-side heat exchangers 52*a*, 52*b*, and 52*c*.

Then, the high-pressure refrigerant sent to the utilization-side heat exchangers 52*a*, 52*b*, and 52*c* exchanges heat with indoor air supplied by the indoor fans 53*a*, 53*b*, and 53*c* in the utilization-side heat exchangers 52*a*, 52*b*, and 52*c*. The refrigerant flowing in the utilization-side heat exchangers 52*a*, 52*b*, and 52*c* thus radiates heat. The indoor air is heated and supplied into the indoor space. The indoor space is thus heated. The refrigerant having radiated heat in the utilization-side heat exchangers 52*a*, 52*b*, and 52*c* flows in the second utilization pipes 56*a*, 56*b*, and 56*c* and passes through the utilization-side expansion valves 51*a*, 51*b*, and 51*c* whose opening degrees are adjusted. The secondary-side refrigerant that has passed through the utilization-side expansion valves 51*a*, 51*b*, and 51*c* has the critical pressure or less. Thereafter, the refrigerant having flowed through the second connecting tubes 16*a*, 16*b*, and 16*c* flows in the third branch pipes 61*a*, 61*b*, and 61*c* of the branch units 6*a*, 6*b*, and 6*c*.

The refrigerant sent to the third branch pipes 61*a*, 61*b*, and 61*c* is sent to the secondary-side third connection pipe 7 to join.

The refrigerant sent to the secondary-side third connection pipe 7 passes through the third shutoff valve 31 and then is sent to the cascade expansion valve 36. The flow rate of the refrigerant sent to the cascade expansion valve 36 is adjusted at the cascade expansion valve 36, and then, the refrigerant is sent to the cascade heat exchanger 35. In the cascade heat exchanger 35, the secondary-side refrigerant flowing in the secondary-side flow path 35*a* is evaporated into a low-pressure gas refrigerant and is sent to the secondary-side switching mechanism 22, and the primary-side refrigerant flowing in the primary-side flow path 35*b* of the cascade heat exchanger 35 is condensed. Then, the secondary-side low-pressure gas refrigerant sent to the first switching valve 22*a* of the secondary-side switching mechanism 22 is returned to the suction side of the secondary-side compressor 21 through the suction flow path 23 and the secondary-side accumulator 30.

Motion during the heating operation is performed in such a manner.

(9-3) Cooling Main Operation

Figure 5:
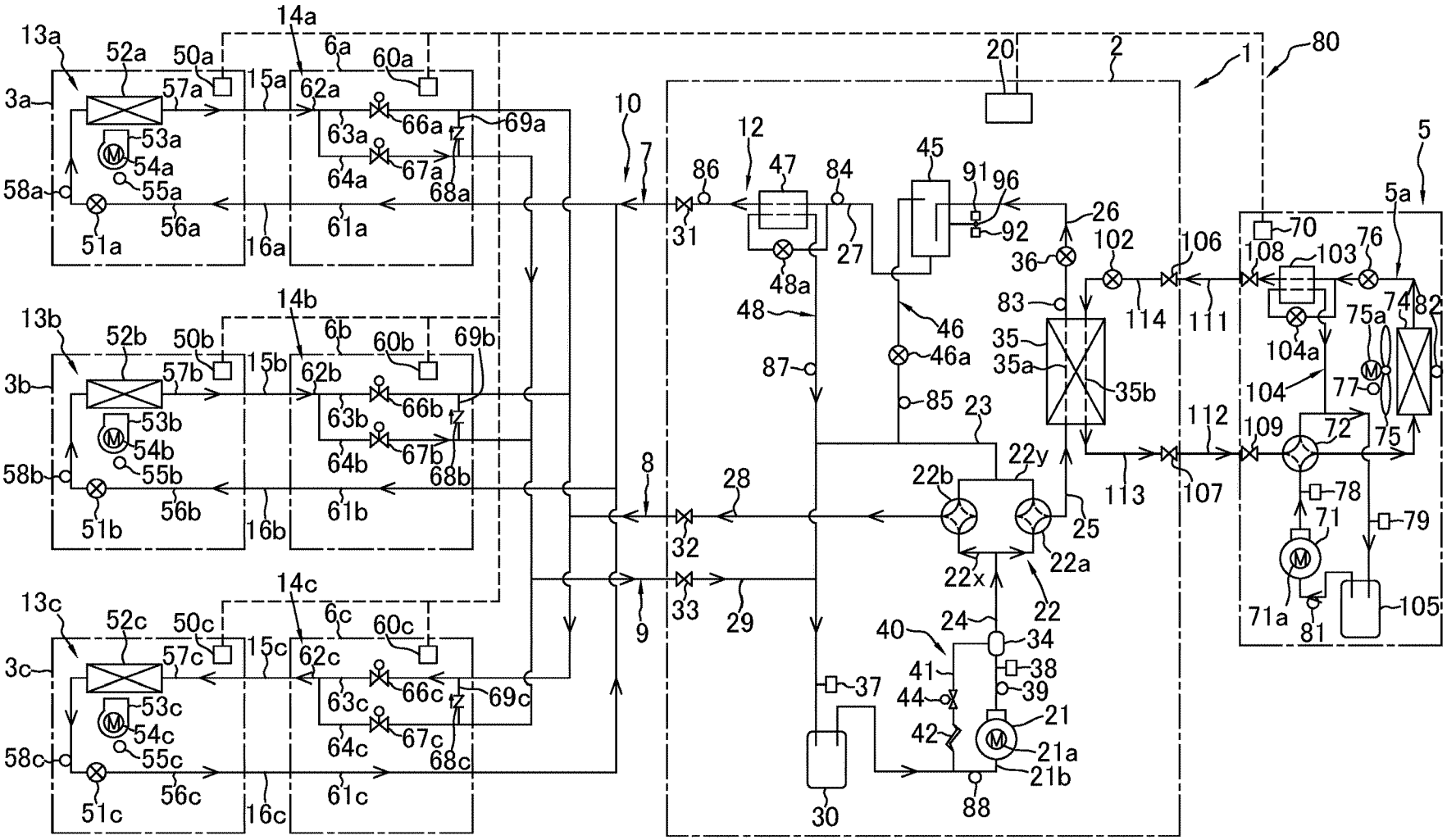
FIG. 5 is a diagram illustrating motion (a flow of a refrigerant) in simultaneous cooling and heating operation (cooling main operation) of the refrigeration cycle apparatus.

During the cooling main operation, for example, the utilization-side heat exchangers 52*a* and 52*b* in the utilization units 3*a* and 3*b* function as refrigerant evaporators, and the utilization-side heat exchanger 52*c* in the utilization unit 3*c* functions as a refrigerant radiator. In the cooling main operation, the cascade heat exchanger 35 functions as a radiator for the secondary-side refrigerant. In the cooling main operation, the primary-side refrigerant circuit 5*a* and the secondary-side refrigerant circuit 10 of the refrigeration cycle apparatus 1 are configured as illustrated in FIG. 5. Arrows attached to the primary-side refrigerant circuit 5*a* and arrows attached to the secondary-side refrigerant circuit 10 in FIG. 5 indicate flows of the refrigerant during the cooling main operation.

Specifically, in the primary-side unit 5, the primary-side switching mechanism 72 is switched to the fifth connection state (the state depicted by solid lines in the primary-side switching mechanism 72 in FIG. 5) to cause the cascade heat exchanger 35 to function as an evaporator for the primary-side refrigerant. Accordingly, in the primary-side unit 5, the primary-side refrigerant discharged from the primary-side compressor 71 passes through the primary-side switching mechanism 72 and exchanges heat with outdoor air supplied from the primary-side fan 75 in the primary-side heat exchanger 74 to be condensed. The primary-side refrigerant condensed in the primary-side heat exchanger 74 passes through the primary-side first expansion valve 76 controlled into a fully opened state, and a part of the refrigerant flows toward the first liquid shutoff valve 108 through the primary-side subcooling heat exchanger 103, and another part of the refrigerant branches into the primary-side subcooling circuit 104. The refrigerant flowing in the primary-side subcooling circuit 104 is decompressed when passing through the primary-side subcooling expansion valve 104*a*. The refrigerant flowing from the primary-side first expansion valve 76 toward the first liquid shutoff valve 108 exchanges heat with the refrigerant decompressed by the primary-side subcooling expansion valve 104*a* and flowing in the primary-side subcooling circuit 104 in the primary-side subcooling heat exchanger 103, and is cooled until reaching a subcooled state. The refrigerant in the subcooled state flows through the primary-side first connection pipe 111, the second liquid shutoff valve 106, and the second refrigerant pipe 114 in that order, and is decompressed by the primary-side second expansion valve 102. At this time, for example, a valve opening degree of the primary-side second expansion valve 102 is controlled such that the degree of superheating of the refrigerant sucked into the primary-side compressor 71 satisfies a predetermined condition. When flowing in the primary-side flow path 35*b* of the cascade heat exchanger 35, the primary-side refrigerant decompressed by the primary-side second expansion valve 102 evaporates by exchanging heat with the secondary-side refrigerant flowing through the secondary-side flow path 35*a*, and flows toward the second gas shutoff valve 107 through the first refrigerant pipe 113. The refrigerant having passed through the second gas shutoff valve 107 passes through the primary-side second connection pipe 112 and the first gas shutoff valve 109, and then reaches the primary-side switching mechanism 72. The refrigerant having passed through the primary-side switching mechanism 72 joins the refrigerant having flowed through the primary-side subcooling circuit 104, and is then sucked into the primary-side compressor 71 via the primary-side accumulator 105.

In the cascade unit 2, the secondary-side switching mechanism 22 is switched to the third connection state in which the discharge flow path 24 and the third pipe 25 are connected by the first switching valve 22*a* and the discharge flow path 24 and the first pipe 28 are connected by the second switching valve 22*b* to cause the cascade heat exchanger 35 to function as a radiator for the secondary-side refrigerant. The opening degree of the cascade expansion valve 36 is adjusted. In the first to third branch units 6*a*, 6*b*, and 6*c*, the first regulating valve 66*c* and the second regulating valves 67*a* and 67*b* are controlled to the opened state, and the first regulating valves 66*a* and 66*b* and the second regulating valve 67*c* are controlled to the closed state. Accordingly, the utilization-side heat exchangers 52*a* and 52*b* in the utilization units 3*a* and 3*b* function as refrigerant evaporators, and the utilization-side heat exchanger 52*c* in the utilization unit 3*c* functions as a refrigerant radiator. The utilization-side heat exchangers 52*a* and 52*b* in the utilization units 3*a* and 3*b* and the suction side of the secondary-side compressor 21 in the cascade unit 2 are connected via the secondary-side second connection pipe 9, and the utilization-side heat exchanger 52*c* in the utilization unit 3*c* and the discharge side of the secondary-side compressor 21 in the cascade unit 2 are connected via the secondary-side first connection pipe 8. In addition, an opening degree of the secondary-side subcooling expansion valve 48*a* is controlled such that a degree of subcooling of the secondary-side refrigerant flowing through the outlet of the secondary-side subcooling heat exchanger 47 toward the secondary-side third connection pipe 7 satisfies a predetermined condition. The bypass expansion valve 46*a* is controlled to the closed state. In the utilization units 3*a*, 3*b*, and 3*c*, the opening degrees of the utilization-side expansion valves 51*a*, 51*b*, and 51*c* are adjusted.

In the cooling main operation, the secondary-side refrigerant circuit 10 controls capacity, for example, by controlling the frequency of the secondary-side compressor 21 such that evaporation temperature in a heat exchanger functioning as an evaporator for the secondary-side refrigerant among the utilization-side heat exchanger 52*a*, 52*b*, and 52*c* becomes a predetermined secondary-side evaporation target temperature. The opening degree of the cascade expansion valve 36 is adjusted such that the secondary-side refrigerant flowing in the cascade heat exchanger 35 has a critical pressure or less. The primary-side refrigerant circuit 5*a* controls capacity, for example, by controlling a frequency of the primary-side compressor 71 such that evaporation temperature of the primary-side refrigerant in the primary-side flow path 35*b* of the cascade heat exchanger 35 becomes a predetermined primary-side evaporation target temperature. In such a manner, in the cooling main operation, either or both of the control for increasing the valve opening degree of the cascade expansion valve 36 and the control for increasing the frequency of the primary-side compressor 71 in the primary-side refrigerant circuit 5*a* are executed, and thus, the carbon dioxide refrigerant flowing in the cascade heat exchanger 35 is controlled so as not to exceed a critical point.

In such a secondary-side refrigerant circuit 10, a part of the secondary-side high-pressure refrigerant compressed and discharged by the secondary-side compressor 21 is sent to the secondary-side first connection pipe 8 through the second switching valve 22*b* of the secondary-side switching mechanism 22, the first pipe 28, and the first shutoff valve 32, and the rest is sent to the secondary-side flow path 35*a* of the cascade heat exchanger 35 through the first switching valve 22*a* of the secondary-side switching mechanism 22 and the third pipe 25.

Then, the high-pressure refrigerant sent to the secondary-side first connection pipe 8 is sent to the first branch pipe 63*c*. The high-pressure refrigerant sent to the first branch pipe 63*c* is sent to the utilization-side heat exchanger 52*c* in the utilization unit 3*c* through the first regulating valve 66*c* and the junction pipe 62*c*.

Then, the high-pressure refrigerant sent to the utilization-side heat exchanger 52*c* exchanges heat with indoor air supplied by the indoor fan 53*c* in the utilization-side heat exchanger 52*c*. The refrigerant flowing in the utilization-side heat exchanger 52*c* thus radiates heat. The indoor air is heated and is supplied into the indoor space, and the utilization unit 3*c* performs the heating operation. The refrigerant having radiated heat in the utilization-side heat exchanger 52*c* flows in the second utilization pipe 56*c*, and the flow rate of the refrigerant is adjusted at the utilization-side expansion valve 51*c*. The refrigerant having flowed through the second connecting tube 16*c* is sent to the third branch pipe 61*c* in the branch unit 6*c*.

Then, the refrigerant sent to the third branch pipe 61*c* is sent to the secondary-side third connection pipe 7.

The high-pressure refrigerant sent to the secondary-side flow path 35*a* of the cascade heat exchanger 35 exchanges heat with the primary-side refrigerant flowing in the primary-side flow path 35*b* in the cascade heat exchanger 35 to radiate heat. The flow rate of the secondary-side refrigerant having radiated heat in the cascade heat exchanger 35 is adjusted at the cascade expansion valve 36, and then the secondary-side refrigerant flows into the secondary-side receiver 45. A part of the refrigerant having flowed out of the secondary-side receiver 45 branches into the secondary-side subcooling circuit 48, is decompressed at the secondary-side subcooling expansion valve 48*a*, and then joins into the suction flow path 23. In the secondary-side subcooling heat exchanger 47, another part of the refrigerant having flowed out of the secondary-side receiver 45 is cooled by the refrigerant flowing in the secondary-side subcooling circuit 48, is then sent to the secondary-side third connection pipe 7 through the third shutoff valve 31, and joins the refrigerant having radiated heat in the utilization-side heat exchanger 52*c*.

Then, the refrigerant having joined in the secondary-side third connection pipe 7 is branched into two portions to be sent to the third branch pipes 61*a* and 61*b* of the branch units 6*a* and 6*b*. Thereafter, the refrigerant having flowed in the second connecting tubes 16*a* and 16*b* is sent to the second utilization pipes 56*a* and 56*b* of the first and second utilization units 3*a* and 3*b*. The refrigerant flowing in the second utilization pipes 56*a* and 56*b* passes through the utilization-side expansion valves 51*a* and 51*b* in the utilization units 3*a* and 3*b*.

The refrigerant having passed through the utilization-side expansion valves 51*a* and 51*b* whose opening degrees are adjusted exchanges heat with indoor air supplied by the indoor fans 53*a* and 53*b* in the utilization-side heat exchangers 52*a* and 52*b*. The refrigerant flowing in the utilization-side heat exchangers 52*a* and 52*b* is thus evaporated into a low-pressure gas refrigerant. The indoor air is cooled and is supplied into the indoor space. The indoor space is thus cooled. The low-pressure gas refrigerant evaporated in the utilization-side heat exchangers 52*a* and 52*b* is sent to the junction pipes 62*a* and 62*b* of the first and second branch units 6*a* and 6*b*.

The low-pressure gas refrigerant sent to the junction pipes 62*a* and 62*b* is sent to the secondary-side second connection pipe 9 via the second regulating valves 67*a* and 67*b* and the second branch pipes 64*a* and 64*b*, to join.

The low-pressure gas refrigerant sent to the secondary-side second connection pipe 9 is returned to the suction side of the secondary-side compressor 21 via the second shutoff valve 33, the second pipe 29, the suction flow path 23, and the secondary-side accumulator 30.

Motion during the cooling main operation is performed in such a manner.

(9-4) Heating Main Operation

Figure 6:
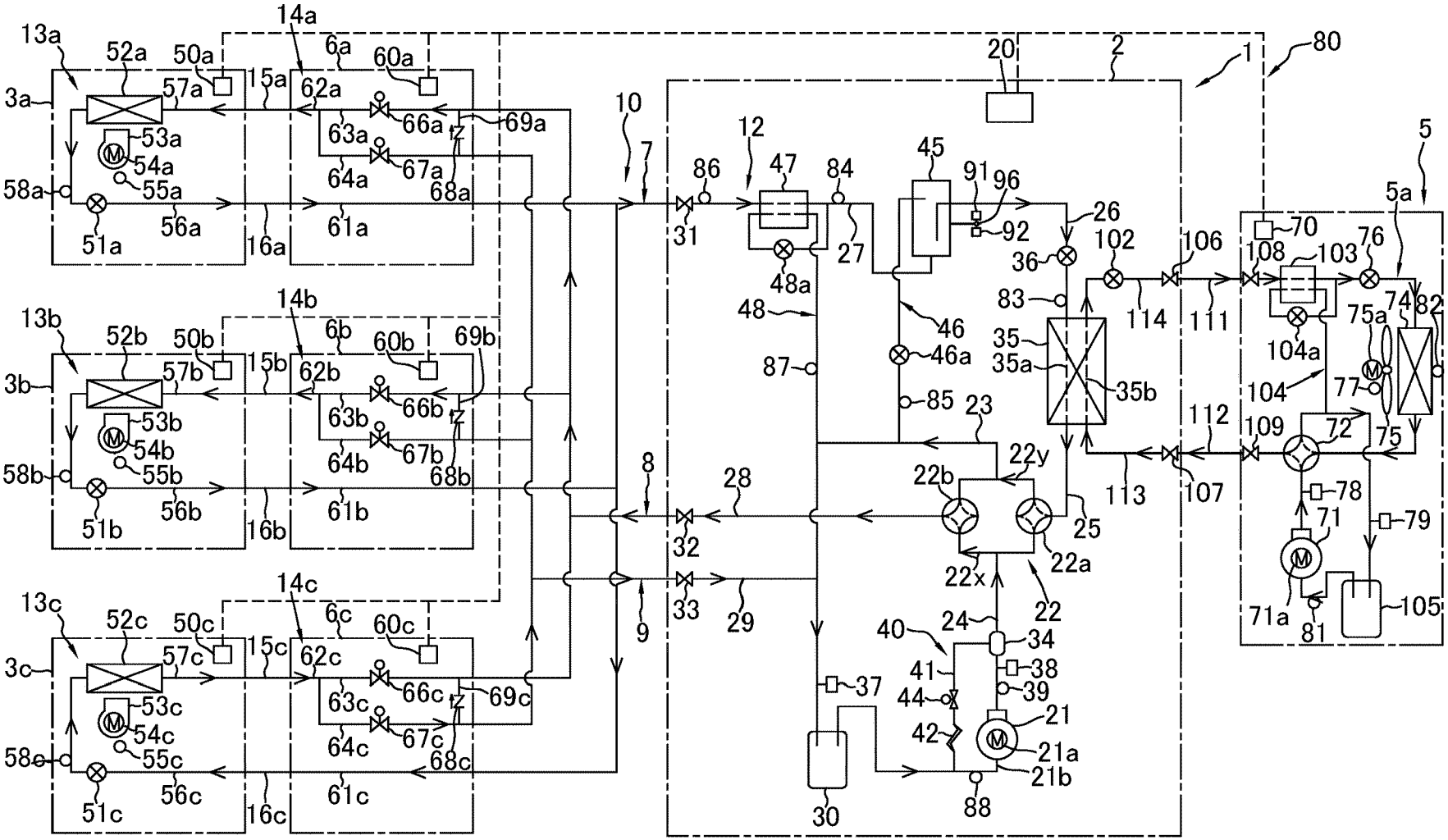
FIG. 6 is a diagram illustrating motion (a flow of a refrigerant) in simultaneous cooling and heating operation (heating main operation) of the refrigeration cycle apparatus.

During the heating main operation, for example, the utilization-side heat exchangers 52*a* and 52*b* in the utilization units 3*a* and 3*b* function as refrigerant radiators, and the utilization-side heat exchanger 52*c* functions as a refrigerant evaporator. In the heating main operation, the cascade heat exchanger 35 functions as an evaporator for the secondary-side refrigerant. In the heating main operation, the primary-side refrigerant circuit 5*a* and the secondary-side refrigerant circuit 10 of the refrigeration cycle apparatus 1 are configured as illustrated in FIG. 6. Arrows attached to the primary-side refrigerant circuit 5*a* and arrows attached to the secondary-side refrigerant circuit 10 in FIG. 6 indicate flows of the refrigerant during the heating main operation.

Specifically, in the primary-side unit 5, the primary-side switching mechanism 72 is switched to a sixth operating state to cause the cascade heat exchanger 35 to function as a radiator for the primary-side refrigerant. The sixth operating state of the primary-side switching mechanism 72 corresponds to a connection state depicted by broken lines in the primary-side switching mechanism 72 in FIG. 6. Accordingly, in the primary-side unit 5, the primary-side refrigerant discharged from the primary-side compressor 71, having passed through the primary-side switching mechanism 72 and the first gas shutoff valve 109 passes through the primary-side second connection pipe 112 and the second gas shutoff valve 107 and is sent to the primary-side flow path 35*b* of the cascade heat exchanger 35. The refrigerant flowing in the primary-side flow path 35*b* of the cascade heat exchanger 35 is condensed by exchanging heat with the secondary-side refrigerant flowing in the secondary-side flow path 35*a*. When flowing in the second refrigerant pipe 114, the primary-side refrigerant condensed in the cascade heat exchanger 35 passes through the primary-side second expansion valve 102 controlled to the fully opened state. Then, the primary-side refrigerant flows through the second liquid shutoff valve 106, the primary-side first connection pipe 111, the first liquid shutoff valve 108, and the primary-side subcooling heat exchanger 103 in that order, and is decompressed by the primary-side first expansion valve 76. During the heating main operation, the primary-side subcooling expansion valve 104*a* is controlled to the closed state. Accordingly, the refrigerant does not flow into the primary-side subcooling circuit 104 and does not exchange heat in the primary-side subcooling heat exchanger 103. The valve opening degree of the primary-side first expansion valve 76 is controlled such that, for example, the degree of superheating of the refrigerant sucked into the primary-side compressor 71 satisfies a predetermined condition. The refrigerant decompressed by the primary-side first expansion valve 76 evaporates by exchanging heat with outdoor air supplied from the primary-side fan 75 in the primary-side heat exchanger 74, passes through the primary-side switching mechanism 72 and the primary-side accumulator 105, and is sucked into the primary-side compressor 71.

In the cascade unit 2, the secondary-side switching mechanism 22 is switched to the second connection state. In the second connection state of the secondary-side switching mechanism 22, the discharge flow path 24 and the first pipe 28 are connected by the second switching valve 22*b*, and the third pipe 25 and the suction flow path 23 are connected by the first switching valve 22*a*. The cascade heat exchanger 35 thus functions as an evaporator for the secondary-side refrigerant. The opening degree of the cascade expansion valve 36 is adjusted. In the first to third branch units 6*a*, 6*b*, and 6*c*, the first regulating valves 66*a* and 66*b* and the second regulating valve 67*c* are controlled to the opened state, and the first regulating valve 66*c* and the second regulating valves 67*a* and 67*b* are controlled to the closed state. Accordingly, the utilization-side heat exchangers 52*a* and 52*b* in the utilization units 3*a* and 3*b* function as refrigerant radiators, and the utilization-side heat exchanger 52*c* in the utilization unit 3*c* functions as a refrigerant evaporator. The utilization-side heat exchanger 52*c* in the utilization unit 3*c* and the suction side of the secondary-side compressor 21 in the cascade unit 2 are connected via the first utilization pipe 57*c*, the first connecting tube 15*c*, the junction pipe 62*c*, the second branch pipe 64*c*, and the secondary-side second connection pipe 9. The utilization-side heat exchangers 52*a* and 52*b* in the utilization units 3*a* and 3*b* and the discharge side of the secondary-side compressor 21 in the cascade unit 2 are connected via the discharge flow path 24, the first pipe 28, the secondary-side first connection pipe 8, the first branch pipes 63*a* and 63*b*, the junction pipes 62*a* and 62*b*, the first connecting tubes 15*a* and 15*b*, and the first utilization pipes 57*a* and 57*b*. The secondary-side subcooling expansion valve 48*a* and the bypass expansion valve 46*a* are controlled to the closed state. In the utilization units 3*a*, 3*b*, and 3*c*, the opening degrees of the utilization-side expansion valves 51*a*, 51*b*, and 51*c* are adjusted.

In the heating main operation, the secondary-side refrigerant circuit 10 controls capacity, for example, by controlling the frequency of the secondary-side compressor 21 so as to process a load in a heat exchanger functioning as a radiator for the secondary-side refrigerant among the utilization-side heat exchangers 52*a*, 52*b*, and 52*c*. As a result, in the heating main operation, the secondary-side refrigerant discharged from the secondary-side compressor 21 is controlled to be in the critical state exceeding the critical pressure. The primary-side refrigerant circuit 5*a* controls capacity, for example, by controlling the frequency of the primary-side compressor 71 such that condensation temperature of the primary-side refrigerant in the primary-side flow path 35*b* of the cascade heat exchanger 35 becomes a predetermined primary-side condensation target temperature.

In such a secondary-side refrigerant circuit 10, the secondary-side high-pressure refrigerant compressed and discharged by the secondary-side compressor 21 is sent to the secondary-side first connection pipe 8 through the second switching valve 22*b* of the secondary-side switching mechanism 22, the first pipe 28, and the first shutoff valve 32.

The high-pressure refrigerant sent to the secondary-side first connection pipe 8 is branched into two portions to be sent to the first branch pipes 63*a* and 63*b* of the first branch unit 6*a* and the second branch unit 6*b* respectively connected to the first utilization unit 3*a* and the second utilization unit 3*b* which are utilization units in operation. The high-pressure refrigerant sent to the first branch pipes 63*a* and 63*b* is sent to the utilization-side heat exchangers 52*a* and 52*b* in the first utilization unit 3*a* and the second utilization unit 3*b* via the first regulating valves 66*a* and 66*b*, the junction pipes 62*a* and 62*b*, and the first connecting tubes 15*a* and 15*b*.

The high-pressure refrigerant sent to the utilization-side heat exchangers 52*a* and 52*b* exchanges heat with indoor air supplied by the indoor fans 53*a* and 53*b* in the utilization-side heat exchangers 52*a* and 52*b*. The refrigerant flowing in the utilization-side heat exchangers 52*a* and 52*b* thus radiates heat. The indoor air is heated and supplied into the indoor space. The indoor space is thus heated. The refrigerant having radiated heat in the utilization-side heat exchangers 52*a* and 52*b* flows in the second utilization pipes 56*a* and 56*b*, and passes through the utilization-side expansion valves 51*a* and 51*b* whose opening degree is adjusted. The secondary-side refrigerant that has passed through the utilization-side expansion valves 51*a* and 51*b* has the critical pressure or less. Thereafter, the refrigerant having flowed through the second connecting tubes 16*a* and 16*b* is sent to the secondary-side third connection pipe 7 via the third branch pipes 61*a* and 61*b* of the branch units 6*a* and 6*b*.

A part of the refrigerant sent to the secondary-side third connection pipe 7 is sent to the third branch pipe 61*c* of the branch unit 6*c*, and the rest flows toward the third shutoff valve 31.

Then, the refrigerant sent to the third branch pipe 61*c* flows in the second utilization pipe 56*c* of the utilization unit 3*c* via the second connecting tube 16*c*, and is sent to the utilization-side expansion valve 51*c*.

The refrigerant having passed through the utilization-side expansion valve 51*c* whose opening degree is adjusted exchanges heat with indoor air supplied by the indoor fan 53*c* in the utilization-side heat exchanger 52*c*. The refrigerant flowing in the utilization-side heat exchanger 52*c* is thus evaporated into a low-pressure gas refrigerant. The indoor air is cooled and is supplied into the indoor space. The indoor space is thus cooled. The low-pressure gas refrigerant evaporated in the utilization-side heat exchanger 52*c* passes through the first utilization pipe 57*c* and the first connecting tube 15*c* to be sent to the junction pipe 62*c*.

The low-pressure gas refrigerant sent to the junction pipe 62*c* is sent to the secondary-side second connection pipe 9 through the second regulating valve 67*c* and the second branch pipe 64*c*.

The low-pressure gas refrigerant sent to the secondary-side second connection pipe 9 is returned to the suction side of the secondary-side compressor 21 via the second shutoff valve 33, the second pipe 29, the suction flow path 23, and the secondary-side accumulator 30.

The refrigerant flowing toward the third shutoff valve 31 is sent to the cascade expansion valve 36. The refrigerant sent to the cascade expansion valve 36 passes through the cascade expansion valve 36 whose opening degree is adjusted, and then exchanges heat with the primary-side refrigerant flowing in the primary-side flow path 35*b* in the secondary-side flow path 35*a* of the cascade heat exchanger 35. As a result, the refrigerant flowing in the secondary-side flow path 35*a* of the cascade heat exchanger 35 evaporates to become a low-pressure gas refrigerant, and is sent to the first switching valve 22*a* of the secondary-side switching mechanism 22. The low-pressure gas refrigerant sent to the first switching valve 22*a* of the secondary-side switching mechanism 22 joins the low-pressure gas refrigerant evaporated in the utilization-side heat exchanger 52*c* in the suction flow path 23. The refrigerant thus joined is returned to the suction side of the secondary-side compressor 21 via the secondary-side accumulator 30.

Motion during the heating main operation is performed in such a manner.

Figure 7:
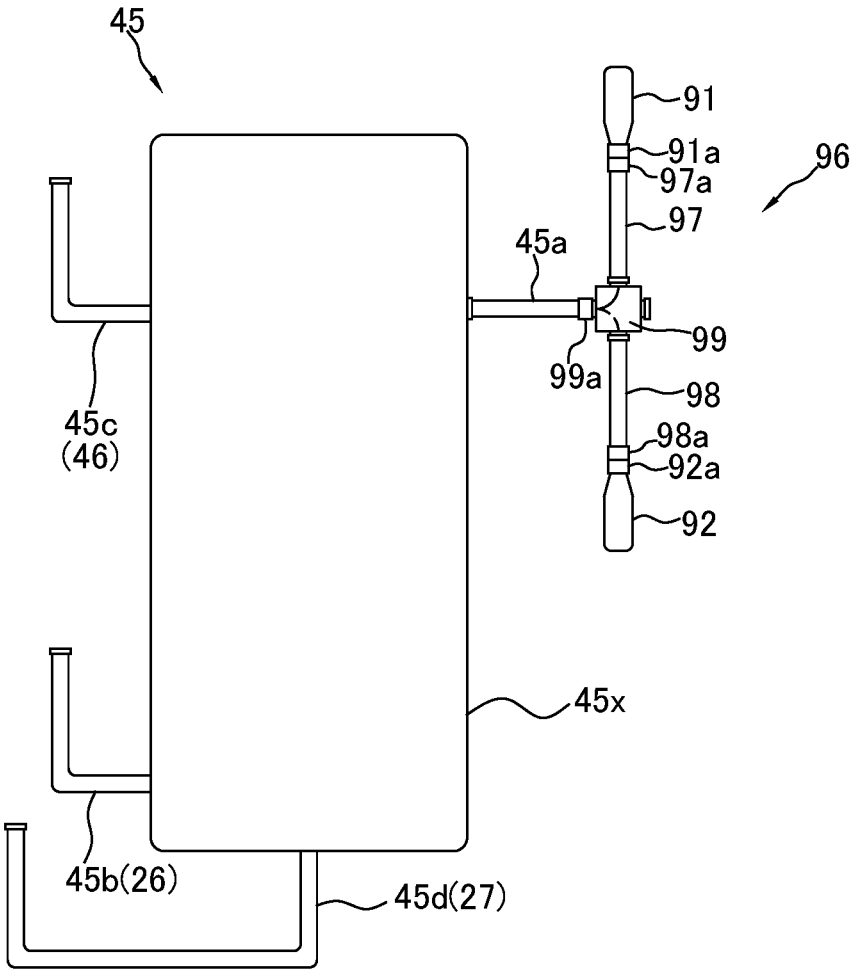
FIG. 7 is a schematic configuration diagram of a secondary-side receiver, a flow path switching portion, a first safety valve, and a second safety valve.
Figure 8:
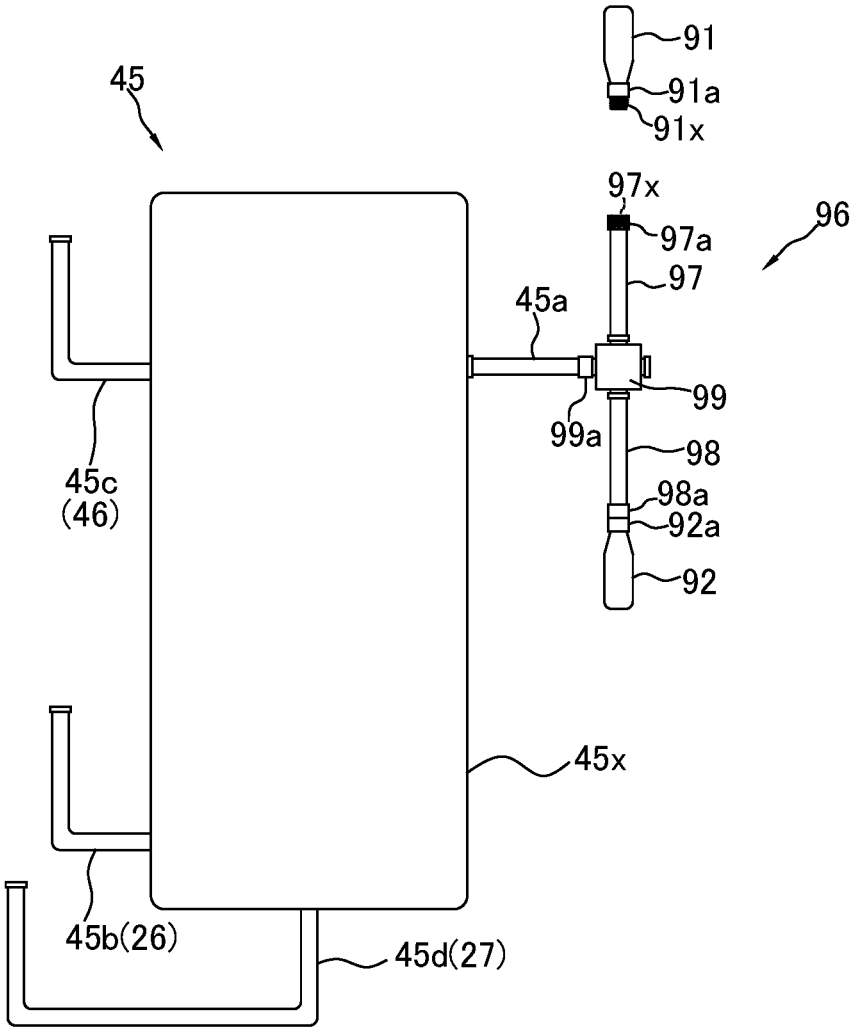
FIG. 8 is an explanatory configuration diagram in a state where the first safety valve is detached.

(10) Secondary-Side Receiver, Flow Path Switching Portion, First Safety Valve, and Second Safety Valve FIG. 7 is a schematic configuration diagram of the secondary-side receiver 45, the flow path switching portion 96, the first safety valve 91, and the second safety valve 92. FIG. 8 is a schematic explanatory diagram illustrating a state where the first safety valve 91 is detached.

In the present embodiment, the secondary-side receiver 45 includes iron or an iron alloy such as carbon steel. When the secondary-side receiver 45 is made of carbon steel, the content of carbon is 0.04 wt % or more and 2 wt % or less. The secondary-side receiver 45 includes a vessel body 45*x*, a first connection portion 45*a*, a second connection portion 45*b*, a third connection portion 45*c*, and a fourth connection portion 45*d*. The vessel body 45*x* is a substantially cylindrical vessel having an internal volume corresponding to the amount of refrigerant filled in the secondary-side refrigerant circuit 10, and temporarily reserves the refrigerant flowing in the secondary-side refrigerant circuit 10. The first connection portion 45*a* is a pipe extending laterally from a part of a peripheral surface of the vessel body 45*x*, and is connected to a third connecting portion 99*a* of the flow path switching portion 96. The second connection portion 45*b* is a pipe extending laterally from a part of a peripheral surface of the vessel body 45*x*, and constitutes a part of the fourth pipe 26 in the secondary-side refrigerant circuit 10. The third connection portion 45*c* is a pipe extending laterally from a part of a peripheral surface of the vessel body 45*x*, and constitutes a part of the bypass circuit 46 in the secondary-side refrigerant circuit 10. The fourth connection portion 45*d* is a pipe extending downward from a bottom of the vessel body 45*x*, and constitutes a part of the fifth pipe 27 in the secondary-side refrigerant circuit 10. An end of the third connection portion 45*c* in the vessel body 45*x* is positioned above an end of the second connection portion 45*b* in the vessel body 45*x* and an end of the fourth connection portion 45*d* in the vessel body 45*x*.

There is no limitation on a connection point and a direction of the connection of the first connection portion 45*a*, the second connection portion 45*b*, the third connection portion 45*c*, and the fourth connection portion 45*d* to the vessel body 45*x*.

In the present embodiment, the flow path switching portion 96 is made of stainless steel. Stainless steel is an alloy containing iron as a main component, a chromium content of 10.5 wt % or more, and a carbon content of 1.2 wt % or less (the same applies hereinafter). Examples of the stainless steel include SUS304, SUS316, SUS303, SUS410, and SUS430, and among the above, any one of SUS304TP, SUS304HTP, SUS304LTP, or SUS316LTP is preferable. The flow path switching portion 96 includes a flow path switching valve 99, the third connecting portion 99*a*, a first connecting pipe 97, and a second connecting pipe 98.

The first connecting pipe 97 extends from one of the connection ports of the flow path switching valve 99, and has a first connecting portion 97*a* at an end of the first connecting pipe 97. The first safety valve connecting portion 91*a* of the first safety valve 91 is connected to the first connecting portion 97*a* of the first connecting pipe 97. Note that the first connecting pipe 97 and the flow path switching valve 99 are connected to each other by welding, for example. The first connecting portion 97*a* is provided with a screw groove 97*x* corresponding to a screw thread 91*x* of the first safety valve connecting portion 91*a* of the first safety valve 91 described later. Accordingly, the first safety valve 91 is screwed and connected to the first connecting portion 97*a*.

The second connecting pipe 98 extends from one of the connection ports of the flow path switching valve 99, and has a second connecting portion 98*a* at an end of the second connecting pipe 98. The second safety valve connecting portion 92*a* of the second safety valve 92 is connected to the second connecting portion 98*a* of the second connecting pipe 98. Note that the second connecting pipe 98 and the flow path switching valve 99 are connected to each other by welding, for example. The second connecting portion 98*a* is provided with a screw groove corresponding to a screw thread (not illustrated) of the second safety valve connecting portion 92*a* of the second safety valve 92 described later. Accordingly, the second safety valve 92 is screwed and connected to the second connecting portion 98*a*.

The third connecting portion 99*a* connects one of the connection ports of the flow path switching valve 99 and the first connection portion 45*a* of the secondary-side receiver 45. Note that the flow path switching valve 99, the third connecting portion 99*a*, and the first connection portion 45*a* are connected to each other by welding, for example.

The flow path switching valve 99 includes a plurality of connection ports, and is a switching valve that switches between a state in which the third connecting portion 99*a* and the first connecting portion 97*a* are connected and a state in which the third connecting portion 99*a* and the second connecting portion 98*a* are connected. In the present embodiment, the flow path switching valve 99 is, for example, a manual valve. The flow path switching valve 99 may include, for example, a three-way valve, or may include three connection ports of a four-way valve.

Each of the first safety valve 91 and the second safety valve 92 functions in a state of communicating with the secondary-side receiver 45, and can automatically release the secondary-side refrigerant to the outside when the pressure of the secondary-side refrigerant in the secondary-side receiver 45 becomes a predetermined value or more. Such a safety valve is also referred to as a pressure relief valve, and includes, for example, a pressure relief valve. As a result, an abnormal increase in the pressure of the secondary-side refrigerant in the secondary-side receiver 45 is suppressed. As such a safety valve, for example, any of a weight safety valve, a lever safety valve, a spring safety valve, or the like can be used. Note that the safety valve is detached at a predetermined frequency such as once a year to confirm that the safety valve functions appropriately. As this confirmation work, for example, when the safety valve is a spring safety valve, whether the spring functions appropriately is confirmed.

In the present embodiment, the first safety valve 91 is made of stainless steel. The first safety valve 91 and the flow path switching portion 96 may include different types of stainless steel, but preferably include the same type of stainless steel from the viewpoint of suppressing corrosion due to a potential difference. The first safety valve 91 has the first safety valve connecting portion 91*a* for connecting to the first connecting portion 97*a* of the first connecting pipe 97. The first safety valve connecting portion 91*a* has the screw thread 91*x* corresponding to the screw groove 97*x* provided in the first connecting portion 97*a*.

In the present embodiment, the second safety valve 92 is made of stainless steel. The second safety valve 92 and the flow path switching portion 96 may include different types of stainless steel, but preferably include the same type of stainless steel from the viewpoint of suppressing corrosion due to a potential difference. The second safety valve 92 has the second safety valve connecting portion 92*a* for connecting to the second connecting portion 98*a* of the second connecting pipe 98. The second safety valve connecting portion 92*a* has a screw thread (not illustrated) corresponding to the screw groove provided in the second connecting portion 98*a*.

The flow path switching portion 96, the first safety valve 91, and the second safety valve 92 described above satisfy the following material relationship.

The potential difference between the first connecting portion 97*a* of the flow path switching portion 96 and the first safety valve connecting portion 91*a* of the first safety valve 91 is 0.35 V or less, preferably 0.3 V or less, and more preferably 0.2 V or less. The potential difference between the second connecting portion 98*a* of the flow path switching portion 96 and the second safety valve connecting portion 92*a* of the second safety valve 92 is 0.35 V or less, preferably 0.3 V or less, and more preferably 0.2 V or less. Since the potential difference between connecting parts is less than 0.35 V, metal corrosion at the connection point is suppressed. The potential difference may be a value measured under the condition of 10° C. to 27° C. at the flow rate of 24 m/s to 40 m/s in seawater.

An allowable tensile stress of the first safety valve connecting portion 91*a* of the first safety valve 91 with respect to an allowable tensile stress of the first connecting portion 97*a* of the flow path switching portion 96 (the allowable tensile stress of the first safety valve connecting portion 91*a* of the first safety valve 91/the allowable tensile stress of the first connecting portion 97*a* of the flow path switching portion 96) is 3.0 times or less, preferably 2.5 times or less, and more preferably 2.0 times or less. An allowable tensile stress of the second safety valve connecting portion 92*a* of second safety valve 92 with respect to an allowable tensile stress of the second connecting portion 98*a* of the flow path switching portion 96 (the allowable tensile stress of the second safety valve connecting portion 92*a* of the second safety valve 92/the allowable tensile stress of the second connecting portion 98*a* of the flow path switching portion 96) is 3.0 times or less, preferably 2.5 times or less, and more preferably 2.0 times or less. Since the value of the ratio of the allowable tensile stresses of the connecting parts is 3.0 times or less, the allowable tensile stress of the first connecting portion 97*a* of the flow path switching portion 96 is not excessively smaller than the allowable tensile stress of the first safety valve connecting portion 91*a* of the first safety valve 91. Therefore, the screw groove 97*x* of the first connecting portion 97*a* of the flow path switching portion 96 is prevented from being crushed by repetition of attachment and detachment of the first safety valve 91. In addition, the value of the ratio of the allowable tensile stresses of the connecting parts is 3.0 times or less, and the allowable tensile stress of the second connecting portion 98*a* of the flow path switching portion 96 is not excessively smaller than the allowable tensile stress of the second safety valve connecting portion 92*a* of the second safety valve 92. Therefore, the screw groove of the second connecting portion 98*a* of the flow path switching portion 96 is prevented from being crushed by repeated attachment and detachment of the second safety valve 92. Note that the allowable tensile stress may be a value at normal temperature, which is an environment where the safety valve is detached.

The lower limit of the allowable tensile stress of the first safety valve connecting portion 91*a* of the first safety valve 91 with respect to the allowable tensile stress of the first connecting portion 97*a* of the flow path switching portion 96 is not limited, but may be, for example, 0.3 or more, preferably 0.5 or more, and may be 1.0 or more. The lower limit of the allowable tensile stress of the second safety valve connecting portion 92*a* of the second safety valve 92 with respect to the allowable tensile stress of the second connecting portion 98*a* of the flow path switching portion 96 is not limited, but may be, for example, 0.3 or more, preferably 0.5 or more, and may be 1.0 or more. As a result, the first safety valve connecting portion 91*a* of the first safety valve 91 and the second safety valve connecting portion 92*a* of the second safety valve 92 are prevented from being damaged by repeated attachment and detachment.

The flow paths of the first safety valve 91 and the second safety valve 92 described above are switched by the flow path switching valve 99 of the flow path switching portion 96, so that the first safety valve 91 or the second safety valve 92 that communicates with the secondary-side receiver 45 functions as a safety valve. For example, the operation of the refrigeration cycle apparatus 1 is stopped after being used for a predetermined period in a state where the first safety valve 91 and the secondary-side receiver 45 communicate with each other, and a state where the first safety valve 91 and the secondary-side receiver 45 communicate with each other is switched to a state where the second safety valve 92 and the secondary-side receiver 45 communicate with each other in a state where both the first safety valve 91 and the second safety valve 92 are screwed and connected to the flow path switching portion 96. In this state, the first safety valve 91 is detached from the flow path switching portion 96, and the first safety valve 91 can be inspected. In a state where the first safety valve 91 is detached from the flow path switching portion 96, a state where the second safety valve 92 is connected to the secondary-side receiver 45 which is a refrigerant vessel of the secondary-side refrigerant circuit 10 is still maintained. Therefore, when the first safety valve 91 is detached and inspected, an abnormal increase in the pressure of the secondary-side refrigerant in the secondary-side receiver 45 is also suppressed, and the reliability of the secondary-side refrigerant circuit 10 is secured. By using the two safety valves, namely, the first safety valve 91 and the second safety valve 92, it is not necessary to perform work such as recovery of the refrigerant in the secondary-side refrigerant circuit 10 every time the safety valve is inspected.

(11) Characteristics of Embodiment

In the refrigeration cycle apparatus 1 according to the present embodiment, since the potential difference between the first connecting portion 97*a* of the flow path switching portion 96 and the first safety valve connecting portion 91*a* of the first safety valve 91 and the potential difference between the second connecting portion 98*a* of the flow path switching portion 96 and the second safety valve connecting portion 92*a* of the second safety valve 92 are small, metal corrosion at the connection point is suppressed.

The value of the ratio of the allowable tensile stress of the first safety valve connecting portion 91*a* of the first safety valve 91 to the allowable tensile stress of the first connecting portion 97*a* of the flow path switching portion 96 (the allowable tensile stress of the first safety valve connecting portion 91*a*/the allowable tensile stress of the first connecting portion 97*a*) is small. Accordingly, the screw groove 97*x* of the first connecting portion 97*a* of the flow path switching portion 96 is prevented from being crushed by repeated attachment and detachment of the first safety valve 91. The value of the ratio of the allowable tensile stress of the second safety valve connecting portion 92*a* of the second safety valve 92 to the allowable tensile stress of the second connecting portion 98*a* of the flow path switching portion 96 (the allowable tensile stress of the second safety valve connecting portion 92*a*/the allowable tensile stress of the second connecting portion 98*a*) is small. Accordingly, the screw groove of the second connecting portion 98*a* of the flow path switching portion 96 is prevented from being crushed by repeated attachment and detachment of the second safety valve 92.

In particular, in the present embodiment, since all of the flow path switching portion 96, the first safety valve 91, and the second safety valve 92 are made of stainless steel, the strength is sufficiently secured, and even if the attachment and detachment of the first safety valve 91 and the second safety valve 92 are repeated, the state of each connecting portion of the first safety valve 91, the second safety valve 92, and the flow path switching portion 96 is favorably maintained.

In the refrigeration cycle apparatus 1 according to the present embodiment, the carbon dioxide refrigerant is filled in the secondary-side refrigerant circuit 10. When the carbon dioxide refrigerant is in the supercritical state, there is a possibility that the behavior of the refrigerant temperature becomes unstable. However, in the present embodiment, a safety valve that functions in accordance with the pressure of the carbon dioxide refrigerant rather than the temperature of the carbon dioxide refrigerant is used. Accordingly, the reliability of the refrigeration cycle apparatus 1 can be enhanced.

(12) Other Embodiments

(12-1) Another Embodiment A

In the above embodiment, as an example, a case has been described where the flow path switching portion 96 includes the first connecting pipe 97 having the first connecting portion 97*a* and the second connecting pipe 98 having the second connecting portion 98*a*.

Figure 9:
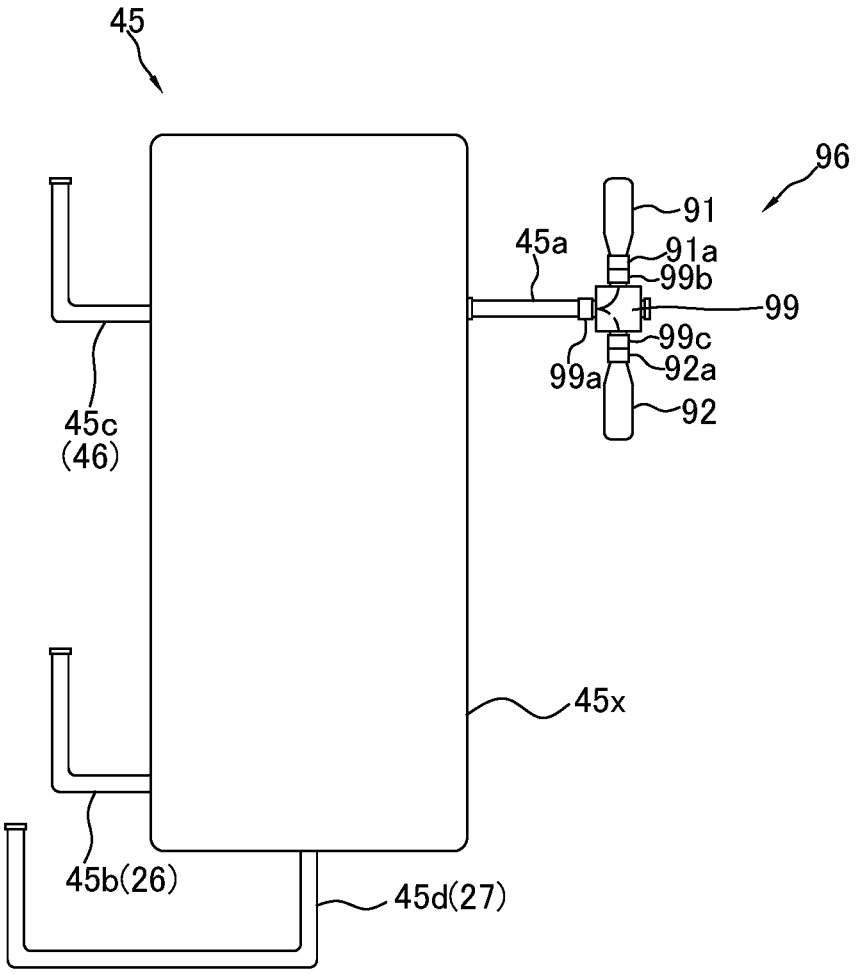
FIG. 9 is a schematic configuration diagram of a secondary-side receiver, a flow path switching portion, a first safety valve, and a second safety valve according to another embodiment A.

Alternatively, for example, as illustrated in FIG. 9, the flow path switching portion 96 according to another embodiment A is not required to include the first connecting pipe 97 and the second connecting pipe 98 according to the above embodiment. The flow path switching portion 96 according to another embodiment A may include a first connecting portion 99*b* instead of the first connecting portion 97*a* according to the above embodiment, and may include a second connecting portion 99*c* instead of the second connecting portion 98*a*.

The first connecting portion 99*b* connects one of the connection ports of the flow path switching valve 99 and the first safety valve connecting portion 91*a* of the first safety valve 91. The first connecting portion 99*b* is provided with a screw groove corresponding to the screw thread 91*x* of the first safety valve connecting portion 91*a* of the first safety valve 91. The second connecting portion 99*c* connects one of the connection ports of the flow path switching valve 99 and the second safety valve connecting portion 92*a* of the second safety valve 92. The second connecting portion 99*c* is provided with a screw groove corresponding to a screw of the second safety valve connecting portion 92*a* of the second safety valve 92.

In the above configuration, as in the above embodiment, the screw groove is prevented from being crushed while metal corrosion in the connecting portion is suppressed.

(12-2) Another Embodiment B

In the above embodiment, as an example, a case has been described where the first safety valve 91 has the screw thread 91*x*, the second safety valve 92 has the screw thread, the first connecting portion 97*a* of the first connecting pipe 97 has the screw groove 97*x*, and the second connecting portion 98*a* of the second connecting pipe 98 has the screw groove.

Alternatively, the relationship between the screw thread and the screw groove is not limited to the above. For example, contrary to the above embodiment, the first safety valve 91 and the second safety valve 92 may have a screw groove, and the first connecting portion 97*a* of the first connecting pipe 97 and the second connecting portion 98*a* of the second connecting pipe 98 may have a screw thread.

(12-3) Another Embodiment C

In the above embodiment, as an example, a case has been described where all of the flow path switching portion 96, the first safety valve 91, and the second safety valve 92 are made of stainless steel.

Alternatively, for example, the relationship between these materials is not limited to the above, and for example, the first safety valve 91 and the second safety valve 92 may be made of stainless steel, the flow path switching portion 96 may include brass, a copper alloy of copper and zinc with 20 wt % or more of zinc. Examples of such brass include C3601BD, C3602BE, C3602BD, C3603BD, C3604BE, C3604BD, C3712BE, C3712BD, C3771BE, and C3771BD specified in JIS. Although stainless steel and brass achieve dissimilar metal connections, the potential difference is as low as about 0.2 V, and thus, metal corrosion is unlikely to occur. In addition, since the ratio of the allowable tensile stress (stainless steel/brass) between stainless steel and brass is from about 1.4 to about 1.6, damage to the connecting parts due to repeated attachment and detachment of the safety valve can also be suppressed to be little.

Furthermore, in addition to the above, for example, the first safety valve 91 and the second safety valve 92 may be made of stainless steel, and the flow path switching portion 96 may be made of copper or a copper alloy. Examples of such copper or copper alloy include C1220T and C1220TS specified in JIS. Although stainless steel and copper or copper alloy achieve dissimilar metal connections, the potential difference is as low as about 0.2 V, and thus, metal corrosion is unlikely to occur. In addition, since the ratio of the allowable tensile stress (stainless steel/brass) between stainless steel and copper or copper alloy is from about 1.1 to about 2.1, damage to the connecting parts due to repeated attachment and detachment of the safety valve can also be suppressed to be little.

(12-4) Another Embodiment D

In the above embodiment, as an example, a case has been described where the entire flow path switching portion 96 includes the same material such as stainless steel.

Alternatively, in the flow path switching portion 96, the flow path switching valve 99, the first connecting pipe 97, and the second connecting pipe 98 may include different metals. In this case, the first connecting pipe 97 and the second connecting pipe 98 having the connecting portion with the first safety valve 91 or the second safety valve 92 preferably include a material having a higher allowable tensile stress than the flow path switching valve 99 in order to suppress damage to the connecting portion at a time of attachment and detachment.

Specifically, for example, the first connecting pipe 97 and the second connecting pipe 98 may be made of stainless steel, and the flow path switching valve 99 may include brass or another copper alloy. For example, the first connecting pipe 97 and the second connecting pipe 98 may include brass, and the flow path switching valve 99 may include another copper alloy.

(12-5) Another Embodiment E

In the above embodiment, as an example, a case has been described where the flow path switching portion 96 is connected to the first connection portion 45*a* extending from the vessel body 45*x* of the secondary-side receiver 45.

Figure 10:
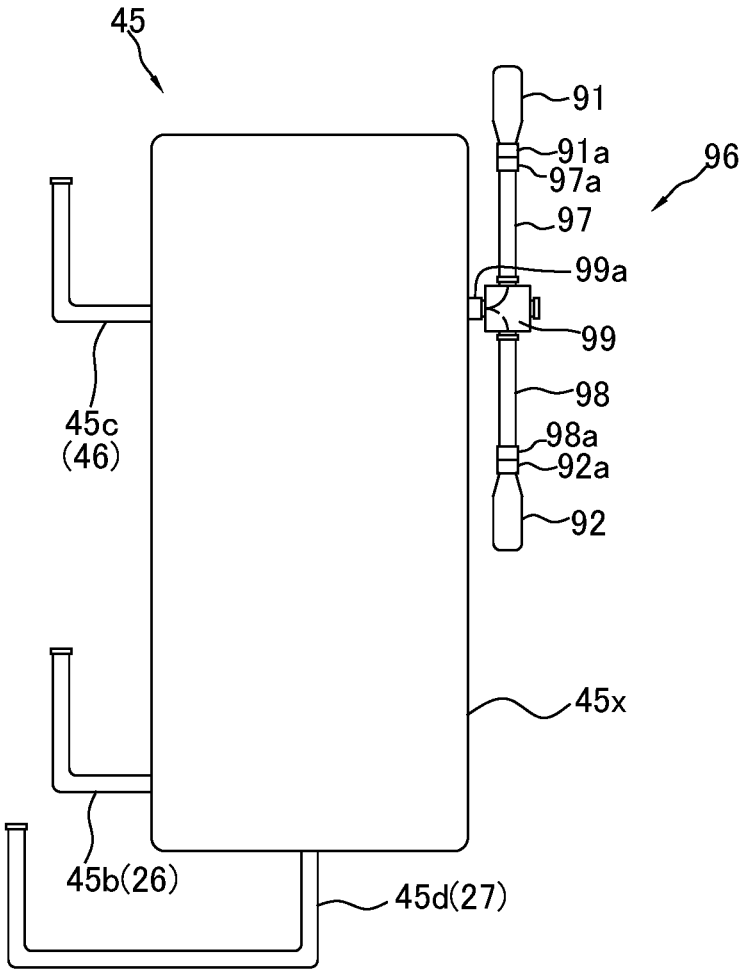
FIG. 10 is a schematic configuration diagram of a secondary-side receiver, a flow path switching portion, a first safety valve, and a second safety valve according to another embodiment E.

Alternatively, for example, as illustrated in FIG. 10, the first connection portion 45*a* extending from the vessel body 45*x* of the secondary-side receiver 45 is may not required to be provided, and the flow path switching portion 96 may be connected to the vessel body 45*x* of the secondary-side receiver 45. Specifically, the third connecting portion 99*a* of the flow path switching portion 96 may be connected to an opening provided in the vessel body 45*x* of the secondary-side receiver 45.

(12-6) Another Embodiment F

In the above embodiment, description has been made by exemplifying the refrigeration cycle apparatus 1 in which one cascade unit 2 is connected to one primary-side unit 5.

Figure 11:
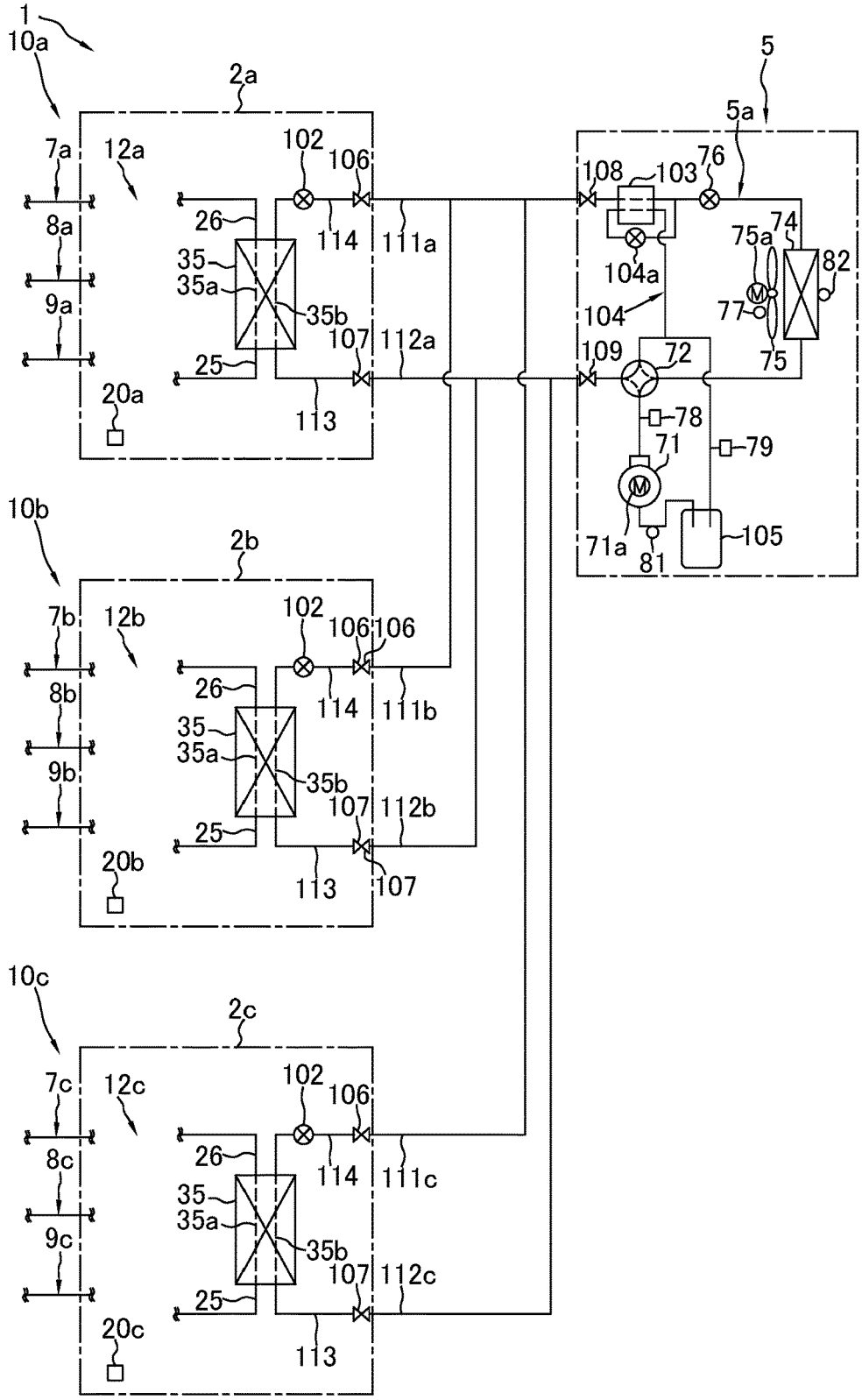
FIG. 11 is a schematic configuration diagram of a refrigeration cycle apparatus according to another embodiment F.

Alternatively, as illustrated in FIG. 11, for example, by connecting a plurality of cascade units, namely, a first cascade unit 2*a*, a second cascade unit 2*b*, and a third cascade unit 2*c*, in parallel to each other to one primary-side unit 5, the refrigeration cycle apparatus 1 may include a first secondary-side refrigerant circuit 10*a* including a first cascade circuit 12*a*, a second secondary-side refrigerant circuit 10*b* including a second cascade circuit 12*b*, and a third secondary-side refrigerant circuit 10*c* including a third cascade circuit 12*c*. Note that, in FIG. 11, an internal structure of each of the first cascade unit 2*a*, the second cascade unit 2*b*, and the third cascade unit 2*c* is similar to that of the cascade unit 2 according to the above embodiment, and thus only a part of each cascade unit is illustrated.

Although not illustrated, each of the first cascade unit 2*a*, the second cascade unit 2*b*, and the third cascade unit 2*c* is connected to the plurality of branch units 6*a*, 6*b*, and 6*c* and the plurality of utilization units 3*a*, 3*b*, and 3*c* as in the above embodiment. Specifically, the first cascade unit 2*a* is connected to a plurality of branch units and utilization units via a secondary-side third connection pipe 7*a*, a secondary-side first connection pipe 8*a*, and a secondary-side second connection pipe 9*a*. The second cascade unit 2*b* is connected, via a secondary-side third connection pipe 7*b*, a secondary-side first connection pipe 8*b*, and a secondary-side second connection pipe 9*b*, to a plurality of branch units and utilization units different from those connected to the first cascade unit 2*a*. The third cascade unit 2*c* is connected, via a secondary-side third connection pipe 7*c*, a secondary-side first connection pipe 8*c*, and a secondary-side second connection pipe 9*c*, to another plurality of branch units and utilization units different from those connected to the first cascade unit 2*a* and different from those connected to the second cascade unit 2*b*.

Here, the primary-side unit 5 and the first cascade unit 2*a* are connected via a primary-side first connection pipe 111*a* and a primary-side second connection pipe 112*a*. The primary-side unit 5 and the second cascade unit 2*b* are connected via a primary-side first connection pipe 111*b* branched from the primary-side first connection pipe 111*a* and a primary-side second connection pipe 112*b* branched from the primary-side second connection pipe 112*a*. The primary-side unit 5 and the third cascade unit 2*c* are connected via a primary-side first connection pipe 111*c* branched from the primary-side first connection pipe 111*a* and a primary-side second connection pipe 112*c* branched from the primary-side second connection pipe 112*a*.

Here, each of the first cascade unit 2*a*, the second cascade unit 2*b*, and the third cascade unit 2*c* includes a primary-side second expansion valve 102 whose opening degree is controlled by the first cascade unit 2*a*, the second cascade unit 2*b*, and the third cascade unit 2*c*. Furthermore, a first cascade-side control unit 20*a* included in the first cascade unit 2*a*, a second cascade-side control unit 20*b* included in the second cascade unit 2*b*, and a third cascade-side control unit 20*c* included in the third cascade unit 2*c* control the opening degree of the corresponding primary-side second expansion valve 102. Similarly to the above embodiment, each of the first cascade-side control unit 20*a*, the second cascade-side control unit 20*b*, and the third cascade-side control unit 20*c* controls the valve opening degree of the corresponding primary-side second expansion valve 102 on the basis of conditions of the first cascade circuit 12*a*, the second cascade circuit 12*b*, and the third cascade circuit 12*c* controlled by the first cascade-side control unit 20*a*, the second cascade-side control unit 20*b*, and the third cascade-side control unit 20*c*. As a result, the primary-side refrigerant flowing through the primary-side refrigerant circuit 5*a* is controlled to have a flow rate of the primary-side refrigerant in the primary-side first connection pipe 111*a* and the primary-side second connection pipe 112*a*, a flow rate of the primary-side refrigerant in the primary-side first connection pipe 111*b* and the primary-side second connection pipe 112*b*, and a flow rate of the primary-side refrigerant in the primary-side first connection pipe 111*c* and the primary-side second connection pipe 112*c* so as to correspond to a difference in loads in the first secondary-side refrigerant circuit 10*a*, the second secondary-side refrigerant circuit 10*b*, and the third secondary-side refrigerant circuit 10*c*.

(12-7) Another Embodiment G

In the above embodiment, R32 or R410A is exemplified as the refrigerant used in the primary-side refrigerant circuit 5*a*, and carbon dioxide is exemplified as the refrigerant used in the secondary-side refrigerant circuit 10.

Alternatively, the refrigerant used in the primary-side refrigerant circuit 5*a* may not be limited, and examples of the refrigerant include HFC-32, an HFO refrigerant, a refrigerant obtained by mixing HFC-32 and the HFO refrigerant, carbon dioxide, ammonia, and propane.

Furthermore, instead of the primary-side refrigerant circuit 5*a* in which the refrigerant flows, a heat medium circuit in which a heat medium such as water or brine flows may be used. In this case, the heat medium circuit may include a heat source that functions as a heat source or a cold source, and a pump for circulating the heat medium. In this case, the flow rate can be adjusted by the pump, and the amount of heat can be controlled by the heat source or the cold source.

The refrigerant used in the secondary-side refrigerant circuit 10 may not be limited, and examples of the refrigerant include HFC-32, an HFO refrigerant, a refrigerant obtained by mixing HFC-32 and the HFO refrigerant, carbon dioxide, ammonia, and propane.

Note that examples of the HFO refrigerant include HFO-1234yf and HFO-1234ze.

The same refrigerant or different refrigerants may be used in the primary-side refrigerant circuit 5*a* and the secondary-side refrigerant circuit 10. Preferably, the refrigerant used in the secondary-side refrigerant circuit 10 has at least one of lower global warming potential (GWP), lower ozone depletion potential (ODP), lower flammability, or lower toxicity than the refrigerant used in the primary-side refrigerant circuit 5*a*. Here, the flammability can be compared in accordance with classifications related to ASHRAE 34 flammability, for example. Note that the toxicity can be compared, for example, in accordance with classifications related to ASHRAE 34 safety grade. In particular, when an overall content volume of the secondary-side refrigerant circuit 10 is larger than an overall content volume of the primary-side refrigerant circuit 5*a*, by using the refrigerant lower than the refrigerant in the primary-side refrigerant circuit 5*a* in at least one of the global warming potential (GWP), the ozone depletion potential (ODP), the flammability, or the toxicity in the secondary-side refrigerant circuit 10, adverse effects when a leak occurs can be reduced.

(12-8) Others

The potential difference between the first connecting portion and the fourth connecting portion is preferably 0.3 V or less, the potential difference between the second connecting portion and the fourth connecting portion is preferably 0.3 V or less, the potential difference between the first connecting portion and the fourth connecting portion is more preferably 0.2 V or less, and the potential difference between the second connecting portion and the fourth connecting portion is more preferably 0.2 V or less.

The potential difference may be a value measured under the condition of 10° C. to 27° C. at a flow rate of 24 m/s to 40 m/s in seawater.

The allowable tensile stress of the fourth connecting portion with respect to the allowable tensile stress of the first connecting portion is preferably 2.5 times or less, the allowable tensile stress of the fourth connecting portion with respect to the allowable tensile stress of the second connecting portion is preferably 2.5 times or less, the allowable tensile stress of the fourth connecting portion with respect to the allowable tensile stress of the first connecting portion is more preferably 2.0 times or less, and the allowable tensile stress of the fourth connecting portion with respect to the allowable tensile stress of the second connecting portion is more preferably 2.0 times or less.

The safety valve having the fourth connecting portion preferably has a first safety valve in which the fourth connecting portion is connected to the first connecting portion, and a second safety valve in which the fourth connecting portion is connected to the second connecting portion.

Examples of the stainless steel is made of SUS such as SUS304, SUS316, SUS303, SUS410, and SUS430.

Supplementary Note

Although the embodiments of the present disclosure have been described above, it will be understood that various changes in form and details can be made without departing from the gist and scope of the present disclosure described in the claims.

REFERENCE SIGNS LIST

1: refrigeration cycle apparatus
2: cascade unit
2*x*: cascade casing
3*a*: first utilization unit
3*b*: second utilization unit
3*c*: third utilization unit
5: primary-side unit
5*a*: primary-side refrigerant circuit
10: secondary-side refrigerant circuit (refrigerant circuit)
12: cascade circuit
13*a*, 13*b*, 13*c*: utilization circuit
20: cascade-side control unit
21: secondary-side compressor
21*a*: compressor motor
22: secondary-side switching mechanism
22*a*: first switching valve
22*b*: second switching valve
22*x*: discharge-side connection portion
22*y*: suction-side connection portion
23: suction flow path
24: discharge flow path
25: third pipe
26: fourth pipe
27: fifth pipe
28: first pipe
29: second pipe
30: secondary-side accumulator
34: oil separator
35: cascade heat exchanger
35*a*: secondary-side flow path
35*b*: primary-side flow path
36: cascade expansion valve
45: secondary-side receiver (refrigerant vessel)
45*a*: first connection portion
45*b*: second connection portion
45*c*: third connection portion
45*d*: fourth connection portion
46: bypass circuit
46*a*: bypass expansion valve
47: secondary-side subcooling heat exchanger
48: secondary-side subcooling circuit
48*a*: secondary-side subcooling expansion valve
50*a-c*: utilization-side control unit
51*a-c*: utilization-side expansion valve
52*a-c*: utilization-side heat exchanger
53*a-c*: indoor fan
58*a*, 58*b*, 58*c*: liquid-side temperature sensor
60*a*, 60*b*, 60*c*: branch unit control unit
66*a*, 66*b*, 66*c*: first regulating valve
67*a*, 67*b*, 67*c*: second regulating valve
68*a*, 68*b*, 68*c*: check valve
69*a*, 69*b*, 69*c*: bypass pipe
70: primary-side control unit
71: primary-side compressor
72: primary-side switching mechanism
74: primary-side heat exchanger
76: primary-side first expansion valve
80: control unit
91: first safety valve (safety valve)
91*a*: first safety valve connecting portion (fourth connecting portion)
91*x*: screw thread
92: second safety valve (safety valve)
92*a*: second safety valve connecting portion (fourth connecting portion)
96: flow path switching portion
97: first connecting pipe
97*a*: first connecting portion
97*x*: screw groove
98: second connecting pipe
98*a*: second connecting portion
99: flow path switching valve
99*a*: third connecting portion
102: primary-side second expansion valve
103: primary-side subcooling heat exchanger
104: primary-side subcooling circuit
104*a*: primary-side subcooling expansion valve
105: primary-side accumulator
111: primary-side first connection pipe
112: primary-side second connection pipe
113: first refrigerant pipe
114: second refrigerant pipe

CITATION LIST

Patent Literature

Patent Literature 1: JP H07-324828 A

The invention claimed is:

1. A refrigeration cycle apparatus comprising:

a refrigerant circuit including a refrigerant vessel that reserves a refrigerant;

a flow path switching portion that includes
- a first connecting portion,
- a second connecting portion,
- a third connecting portion connected to the refrigerant vessel, and
- a flow path switching valve that switches between a first state in which the third connecting portion communicates with the first connecting portion and a second state in which the third connecting portion communicates with the second connecting portion; and a safety valve that includes a fourth connecting portion connected to the first connecting portion or the second connecting portion and releases the refrigerant to outside when a refrigerant pressure in the refrigerant vessel satisfies a predetermined condition, wherein at least the fourth connecting portion of the safety valve is made of stainless steel, and in the flow path switching portion,
- a potential difference between the first connecting portion and the fourth connecting portion is 0.35 V or less,
- a potential difference between the second connecting portion and the fourth connecting portion is 0.35 V or less,
- an allowable tensile stress of the fourth connecting portion with respect to an allowable tensile stress of the first connecting portion is 3.0 times or less, and the allowable tensile stress of the fourth connecting portion with respect to an allowable tensile stress of the second connecting portion is 3.0 times or less.

2. The refrigeration cycle apparatus according to claim 1, wherein the flow path switching portion includes the flow path switching valve having the third connecting portion, a first connecting pipe having the first connecting portion and connected to the flow path switching valve, and a second connecting pipe having the second connecting portion and connected to the flow path switching valve.

3. The refrigeration cycle apparatus according to claim 1, wherein the first connecting portion is made of copper, a copper alloy, or stainless steel, and the second connecting portion is made of copper, a copper alloy, or stainless steel.

4. The refrigeration cycle apparatus according to claim 1, wherein the first connecting portion and the second connecting portion are made of stainless steel.

5. The refrigeration cycle apparatus according to claim 1, wherein the safety valve is a screw-type safety valve in which the fourth connecting portion has a screw thread, and each of the first connecting portion and the second connecting portion of the flow path switching portion has a screw groove corresponding to the fourth connecting portion.

6. The refrigeration cycle apparatus according to claim 1, wherein the refrigerant is a refrigerant containing a carbon dioxide refrigerant.

7. The refrigeration cycle apparatus according to claim 1, wherein the refrigerant vessel is provided at a portion of the refrigerant circuit in which a high-pressure refrigerant flows.

8. The refrigeration cycle apparatus according to claim 2, wherein the first connecting portion is made of copper, a copper alloy, or stainless steel, and the second connecting portion is made of copper, a copper alloy, or stainless steel.

9. The refrigeration cycle apparatus according to claim 2, wherein the first connecting portion and the second connecting portion are made of stainless steel.

10. The refrigeration cycle apparatus according to claim 3, wherein the first connecting portion and the second connecting portion are made of stainless steel.

11. The refrigeration cycle apparatus according to claim 2, wherein the safety valve is a screw-type safety valve in which the fourth connecting portion has a screw thread, and each of the first connecting portion and the second connecting portion of the flow path switching portion has a screw groove corresponding to the fourth connecting portion.

12. The refrigeration cycle apparatus according to claim 3, wherein the safety valve is a screw-type safety valve in which the fourth connecting portion has a screw thread, and each of the first connecting portion and the second connecting portion of the flow path switching portion has a screw groove corresponding to the fourth connecting portion.

13. The refrigeration cycle apparatus according to claim 4, wherein the safety valve is a screw-type safety valve in which the fourth connecting portion has a screw thread, and each of the first connecting portion and the second connecting portion of the flow path switching portion has a screw groove corresponding to the fourth connecting portion.

14. The refrigeration cycle apparatus according to claim 2, wherein the refrigerant is a refrigerant containing a carbon dioxide refrigerant.

15. The refrigeration cycle apparatus according to claim 3, wherein the refrigerant is a refrigerant containing a carbon dioxide refrigerant.

16. The refrigeration cycle apparatus according to claim 4, wherein the refrigerant is a refrigerant containing a carbon dioxide refrigerant.

17. The refrigeration cycle apparatus according to claim 5, wherein the refrigerant is a refrigerant containing a carbon dioxide refrigerant.

18. The refrigeration cycle apparatus according to claim 2, wherein the refrigerant vessel is provided at a portion of the refrigerant circuit in which a high-pressure refrigerant flows.

19. The refrigeration cycle apparatus according to claim 3, wherein the refrigerant vessel is provided at a portion of the refrigerant circuit in which a high-pressure refrigerant flows.

20. The refrigeration cycle apparatus according to claim 4, wherein the refrigerant vessel is provided at a portion of the refrigerant circuit in which a high-pressure refrigerant flows.

* * * * *